US007348117B2

(12) United States Patent
Inoue et al.

(10) Patent No.: US 7,348,117 B2
(45) Date of Patent: Mar. 25, 2008

(54) TONER, METHOD FOR MANUFACTURING THE TONER, DEVELOPER INCLUDING THE TONER, TONER CONTAINER CONTAINING THE TONER, AND IMAGE FORMING METHOD, IMAGE FORMING APPARATUS AND PROCESS CARTRIDGE USING THE TONER

(75) Inventors: Ryohta Inoue, Numazu (JP); Naohiro Watanabe, Suntoh-gun (JP); Masahide Yamada, Numazu (JP); Sonoh Matsuoka, Numazu (JP); Chiaki Tanaka, Tagata-gun (JP); Takeshi Takada, Yokohama (JP); Masahiro Ohki, Numazu (JP); Akinori Saitoh, Numazu (JP)

(73) Assignee: Ricoh Company Limited, Tokyo (JP)

( * ) Notice: Subject to any disclaimer, the term of this patent is extended or adjusted under 35 U.S.C. 154(b) by 423 days.

(21) Appl. No.: 10/910,764

(22) Filed: Aug. 4, 2004

(65) Prior Publication Data

US 2005/0031980 A1 Feb. 10, 2005

(30) Foreign Application Priority Data

Aug. 7, 2003 (JP) ..... 2003-206431
Aug. 7, 2003 (JP) ..... 2003-206433
Sep. 19, 2003 (JP) ..... 2003-327835

(51) Int. Cl.
*G03G 9/08* (2006.01)

(52) U.S. Cl. ..... 430/108.22; 430/108.1; 430/108.4; 430/123.5

(58) Field of Classification Search ..... 430/108.1, 430/108.22, 108.4, 109.4, 123.5
See application file for complete search history.

(56) References Cited

U.S. PATENT DOCUMENTS

| | | | | |
|---|---|---|---|---|
| 6,660,443 | B2 | 12/2003 | Sugiyama et al. | |
| 6,787,280 | B2 | 9/2004 | Yamashita et al. | |
| 7,157,199 | B2 * | 1/2007 | Emoto et al. | 430/108.22 |
| 2003/0077536 | A1 | 4/2003 | Yamashita et al. | |
| 2003/0134220 | A1 | 7/2003 | Emoto et al. | |
| 2003/0138717 | A1 | 7/2003 | Yagi et al. | |
| 2003/0152857 | A1 | 8/2003 | Sugiura et al. | |
| 2003/0152859 | A1 | 8/2003 | Emoto et al. | |
| 2003/0180644 | A1 | 9/2003 | Nanya et al. | |
| 2003/0219670 | A1 | 11/2003 | Sawada et al. | |
| 2004/0115551 | A1 | 6/2004 | Sugiyama et al. | |
| 2004/0121256 | A1 | 6/2004 | Suzuki et al. | |
| 2004/0131961 | A1 | 7/2004 | Watanabe et al. | |
| 2004/0137352 | A1 * | 7/2004 | Mc Stravick et al. | 430/108.11 |
| 2004/0142265 | A1 | 7/2004 | Tomita et al. | |
| 2004/0146795 | A1 | 7/2004 | Emoto et al. | |
| 2004/0175641 | A1 | 9/2004 | Nanya et al. | |

FOREIGN PATENT DOCUMENTS

| | | | |
|---|---|---|---|
| EP | 408471 | A * | 1/1991 |
| EP | 1308790 | A2 * | 5/2003 |
| JP | 60-90344 | | 5/1985 |
| JP | 62-63940 | | 3/1987 |
| JP | 63-186253 | | 8/1988 |
| JP | 64-15755 | | 1/1989 |
| JP | 2-82267 | | 3/1990 |
| JP | 2-287554 | | 11/1990 |
| JP | 3-41470 | | 2/1991 |
| JP | 3-229264 | | 10/1991 |
| JP | 5-66600 | | 3/1993 |
| JP | 9-34167 | | 2/1997 |
| JP | 9-258480 | | 10/1997 |
| JP | 10-26842 | | 1/1998 |
| JP | 2931899 | | 5/1999 |
| JP | 11-149180 | | 6/1999 |
| JP | 11-305486 | | 11/1999 |
| JP | 2000-347455 | | 12/2000 |
| JP | 2001-22117 | | 1/2001 |
| JP | 2001175025 | A * | 6/2001 |

OTHER PUBLICATIONS

U.S. Appl. No. 11/520,642, filed Sep. 14, 2006, Chiaki Tanaka et al.
U.S. Appl. No. 11/519,893, filed Sep. 13, 2006, Ryota Inoue et al.
U.S. Appl. No. 11/227,215, filed Sep. 16, 2005, Tanaka et al.
U.S. Appl. No. 11/226,357, filed Sep. 15, 2005, Tanaka et al.
U.S. Appl. No. 11/224,976, filed Sep. 14, 2005, Inoue et al.
U.S. Appl. No. 11/196,602, filed Aug. 4, 2005, Ohki et al.
U.S. Appl. No. 11/227,566, filed Sep. 16, 2005, Nagatomo et al.
U.S. Appl. No. 11/313,817, filed Dec. 22, 2005, Inoue et al.
U.S. Appl. No. 11/513,175, filed Aug. 31, 2006, Ohki et al.
U.S. Appl. No. 11/561,983, filed Nov. 21, 2006, Sugino et al.
U.S. Appl. No. 11/685,969, filed Mar. 14, 2007, Uchinokura et al.
U.S. Appl. No. 11/676,883, filed Feb. 20, 2007, Tanaka.
U.S. Appl. No. 11/685,872, filed Mar. 14, 2007, Uchinokura et al.
U.S. Appl. No. 11/687,075, filed Mar. 16, 2007, Yamada et al.
U.S. Appl. No. 11/687,372, filed Mar. 16, 2007, Yamada et al.
U.S. Appl. No. 11/695,750, filed Apr. 3, 2007, Takada et al.
U.S. Appl. No. 11/868,618, filed Oct. 8, 2007, Sugiyama et al.

* cited by examiner

*Primary Examiner*—Christopher RoDee
(74) *Attorney, Agent, or Firm*—Oblon, Spivak, McClelland, Maier & Neustadt, P.C.

(57) ABSTRACT

A toner including toner particles comprising a binder resin; and at least two kinds of particulate resins which are located on at least a surface of the toner particles, wherein the toner satisfies at least one of the following relationships (TgA-TgB)≧20° C., wherein TgA and TgB represent glass transition temperatures (Tg) of a particulate resin (A) having a highest Tg and a particulate resin (B) having a lowest Tg among the at least two kinds of particulate resins, respectively; and 100,000≦Mwc≦6,000,000 and 8,000≦Mwd≦800,000, wherein Mwc and Mwd represent weight average molecular weights (Mw) of a particulate resin (C) having a highest Mw and a particulate resin (D) having a lowest Mw among the at least two kinds of particulate resins, respectively, wherein Mwc>Mwd.

19 Claims, 4 Drawing Sheets

TONER, METHOD FOR MANUFACTURING THE TONER, DEVELOPER INCLUDING THE TONER, TONER CONTAINER CONTAINING THE TONER, AND IMAGE FORMING METHOD, IMAGE FORMING APPARATUS AND PROCESS CARTRIDGE USING THE TONER

BACKGROUND OF THE INVENTION

1. Field of the Invention

The present invention relates to a toner for use in developing electrostatic latent images formed by a method such as electrophotography, electrostatic recording and electrostatic printing. In addition, the present invention also relates to a method for manufacturing the toner; a toner container containing the toner; a developer including the toner; and an image forming method, an image forming apparatus and a process cartridge using the toner.

2. Discussion of the Background

Various electrophotographic image forming methods have been disclosed, for example, in U.S. Pat. No. 2,297,691.

In general, electrophotographic image forming methods typically include the following processes:

(1) an electrostatic latent image is formed on an image bearing member such as photoreceptors using one of various methods (latent image forming process);

(2) the electrostatic latent image is developed with a toner to form a visual image (toner image) on the image bearing member (developing process);

(3) the toner image is transferred to a receiving material such as papers optionally via an intermediate transfer medium (transferring process); and (4) the toner image is fixed to the receiving material upon application of heat and/or pressure, resulting in formation of a copy (fixing process).

Various methods have been proposed for the fixing method. Among the various fixing methods, a heat roller fixing method in which a heat roller is directly contacted to a toner image formed on a receiving material while applying pressure thereto has been broadly used because of having advantages such that the fixing device has good heat efficiency and the fixing device can be downsized.

However, the heat roller fixing method has a drawback in that a large power is needed to operate the fixing device. Therefore, various investigations have been made on heat roller fixing devices to reduce the power consumption thereof. For example, there is a proposal in that the thickness of the heat roller which is to be contacted with toner images is minimized as much as possible to improve the heat efficiency of the fixing operation and to shorten the temperature rising time which means the time needed for increasing the temperature of the heat roller in a waiting state to the predetermined fixing temperature.

However, such a fixing device has a drawback in that the heat capacity of the heat roller is decreased and thereby the difference in temperature between a portion (contact portion) of the heat roller contacting receiving material sheets and a portion thereof (non-contact portion) not contacting the receiving materials increases. In this case, if the fixing temperature is controlled while a sensor detects the contact portion, the temperature of the non-contact portion is excessively increased. Therefore, if a receiving material with large size is passed through the heat roller in this state, a hot offset problem in that the toner image thereon is adhered to the heat roller, and the toner image is re-transferred to an undesired portion of the receiving material or the following receiving material tends to occur at the portion of the toner image fixed by the excessively heated portion of the heated roller.

Recently, in order to save energy, investigations have been made on low temperature fixing techniques. In addition, investigations have been made on high speed image forming. Specifically, it has been attempted to develop toners having a low temperature fixability by using a low softening material such as resins and waxes for the toner. However, such low temperature fixable toners often causes a blocking problem in that toner particles are softened and aggregated due to the heat generated by the fixing device and the other image forming devices or when the toners are preserved at a high temperature. Namely, the toners have poor high temperature preservability. In addition, such toners tend to have a relatively narrow fixable temperature range.

In attempting to impart good combination of low temperature fixability and high temperature preservability (hereinafter simply referred to as preservability) to a toner, various investigations have been made. For example, a technique in that a polyester resin, which has a relatively good preservability and a relatively good low temperature fixability, is used as the binder resin of a toner is proposed. However, by using only this technique, it is impossible to impart good combination of preservability and low temperature fixability to the toner. This is because the two characteristics establish trade-off relationship.

In addition, published unexamined Japanese Patent Application No. (hereinafter referred to as JP-A) 09-258480 discloses a toner including layered toner particles in which an outer portion of toner particles includes a resin having a glass transition temperature higher than that of the resin included in the inner portion of the toner particles. Such layered toner can be prepared by a method such as in-situ polymerization methods, interfacial polymerization methods, coacervation methods, spray drying methods, and phase-inversion emulsion methods (disclosed in JP-A 05-66600).

JP-As 2000-347455 and 2001-022117 have disclosed layered toners prepared by a phase-inversion emulsion method, in which a particulate material having a high glass transition temperature is fixed on toner particles. The toners have slightly improved preservability, but do not have a wide fixable temperature range. Namely, the toner does not have good combination of preservability and low temperature fixability.

Japanese Patent No. 2,794,770 (i.e., JP-A 02-287554) discloses a toner having a layered structure in which the outer portion of the toner particles are made of a resin having a molecular weight higher than that of a resin constituting the inner portion thereof. However, the low temperature fixability of the toner is not satisfactory because the toner particles are covered with a high molecular weight resin.

Recently it is very important to save energy. Requirements for next generation image forming apparatuses are described in the DSM (Demand-side Management) program of IEA (International Energy Agency). There are several requirements therein such that the warm-up time should not be greater than 10 seconds and the power consumption in a waiting state should be not greater than 10 to 30 watt (which changes depending on the copying speed) in copiers having a copy speed not less than 30 cpm (copies per minutes).

In attempting to fulfill the requirements, various toners have been developed. For example, toners which uses a polyester resin as a binder resin instead of styrene-acrylic copolymers which have been conventionally used have been disclosed in JP-As 60-90344, 64-15755, 02-82267, 03-229264, 03-41470 and 11-305486. This is because polyester resins have relatively good fixability and good preservability compared to styrene-acrylic copolymers. In addition, JP-A 62-63940 discloses a toner including a specific non-olefin crystal polymer as a binder resin. Further, Japanese Patent No. 2,931,899 discloses a toner including a crystalline polyester as a binder.

However, even such toners cannot fulfill the requirements described in the DSM program.

Methods for manufacturing toners are broadly classified into pulverization methods and suspension polymerization methods.

Pulverization methods typically include the following steps:

(1) mixing a binder resin, a colorant, a charge controlling agent, etc.;
(2) melting and uniformly kneading the mixture, followed by cooling;
(3) pulverizing the mixture; and
(4) classifying the pulverized mixture.

The pulverization methods have the following drawbacks:

(1) A pulverizer is necessary and therefore the manufacturing cost increases.
(2) The pulverized mixture typically has a broad particle diameter distribution. Therefore, when a toner having a relatively small average particle diameter and a narrow particle diameter distribution (for example, from 5 to 20 μm) is prepared to produce high quality images, the yield seriously deteriorates.
(3) It is difficult to uniformly disperse a colorant, a charge controlling agent, etc. in a binder resin. Therefore the toner is poor in fluidity, developability, durability and image qualities.

In suspension polymerization methods, toner constituents including a polymerizable material is suspended in a solvent, followed by polymerization of the polymerizable material, resulting in preparation of toner particles.

The toners prepared by such suspension polymerization methods do not have the drawbacks specific to the toners prepared by pulverization methods. However, the toners have the following drawbacks:

(1) Since the toners have a spherical form, toner particles remaining on image bearing members even after a toner image transfer process cannot be well removed with a cleaning blade. Therefore, a problem in that when an image having a large image area proportion is produced, a large amount of toner articles remain on the image bearing member, thereby causing background fouling in the following copy images. In addition, such residual toner particles contaminate the charging roller or the other elements contacting the image bearing member, and thereby a problem in that image qualities deteriorate occurs.

In addition, Japanese Patent No. 2,537,503 (i.e., JP-A 63-186253) discloses an emulsion polymerization method in which small particles are associated to prepare toner particles having irregular forms. However, the toner has a drawback in that a large amount of surfactant is included in the toner particles, and thereby the toner has poor charge properties (i.e., the toner has wide charge quantity distribution). Therefore, the resultant toner images have background fouling. In addition, the photoreceptor, charging roller and developing roller are contaminated, resulting in deterioration of images.

Recently, an emulsion-aggregation method in which a polymer dissolved in an organic solvent is dispersed in an aqueous medium is polymerized to prepare toner particles is disclosed in Japanese Patent No. 3,141,783 (i.e., JP-A 10-26842). It is described therein that by using the method, a toner having a core-shell structure can be produced. However, the shell serves only to prevent the pigments and waxes from being exposed to the outside. Namely, the surface conditions of the toner particles are not improved by this method. Therefore, the preservability and charge stability of the toner are not improved.

In the conventional suspension polymerization methods, emulsion polymerization methods and emulsion-aggregation methods mentioned above, styrene-acrylic resins are typically used as a binder resin. However, polyester resins, which have good fixability have hardly been used because it is hard to granulize polyester resins and to control the particle diameter, particle diameter distribution and toner particle form. Therefore, JP-A 09-34167 discloses a toner, which is prepared by changing the form of a toner including a polyester resin in an aqueous medium so as to be a spherical form. In addition, JP-A 11-149180 discloses a toner in which toner particles are prepared using an isocyanate.

However, these toners have drawbacks in that the productivity is low and low temperature fixability is not satisfactory.

Thus, there is no toner, which has good combination of high temperature preservability and low temperature fixability.

SUMMARY OF THE INVENTION

Accordingly, an object of the present invention is to provide a toner which has good combination of preservability and low temperature fixability while having good hot offset resistance.

Another object of the present invention is to provide a toner manufacturing method by which the toner mentioned above can be efficiently produced.

Yet another object of the present invention is to provide a developer which has good preservability and by which high quality toner images can be produced.

A further object of the present invention is to provide a process cartridge, an image forming method and an image forming apparatus, by which high quality images can be produced without causing the hot offset problem and the blocking problem.

Briefly these objects and other objects of the present invention as hereinafter will become more readily apparent can be attained by a toner including:

toner particles including a binder resin; and at least two kinds of particulate resins which are located on at least a surface of the toner particles, wherein the toner satisfies at least one of the following relationships (1) and (2):

$$(TgA-TgB) \geqq 20^\circ C. \quad (1)$$

wherein TgA and TgB represent glass transition temperatures of a particulate-resin (A) having a highest glass transition temperature and a particulate resin (B) having a lowest glass transition temperature among the at least two kinds of particulate resins, respectively, and $$100{,}000 \leqq Mwc \leqq 6{,}000{,}000 \text{ and } 8{,}000 \leqq Mwd \leqq 800{,}000 \quad (2)$$

wherein Mwc and Mwd represent weight average molecular weights of tetrahydrofuran-soluble components of a particulate resin (C) having a highest weight average molecular weight and tetrahydrofuran-soluble components of a particulate resin (D) having a lowest weight average molecular weight among the at least two kinds of particulate resins, respectively, wherein Mwc>Mwd.

It is preferable that the toner particles are prepared by a method including the steps of dispersing a compound having an active hydrogen and a polymer capable of reacting the hydrogen atom of the compound in an aqueous medium including the at least two kinds of particulate resins; and reacting the polymer with the compound to prepare the toner particles which include the binder resin and on the surface of which the at least two kinds of particulate resins are present. It is preferable that the method further includes a step of treating a part of the toner particles with a basic aqueous solution to remove the at least two kinds of particulate resins on the surface of the toner particles. In addition, it is preferable that in the treating step a part of the at least two kinds of particulate resins is removed while at least one of the at least two kinds of particulate resins is not removed.

It is preferable that the weight ratio (A/B) of the particulate resin (A) to the particulate resin (B) is 10/90 to 50/50 and the weight ratio (C/D) of the particulate resin (C) to the particulate resin (D) is 10/90 to 50/50.

It is preferable that the at least two kinds of particulate resins cover the surface of the toner particles at a covering rate of from 75 to 100%.

Each of the at least two kinds of particulate resins preferably has a volume average particle diameter of from 20 to 400 nm.

The content of the at least two kinds of particulate resins in the toner is preferably from 0.5 to 8.0% by weight, and preferably from 0.5 to 5.0% by weight, when the amount is determined by a pyrolysis chromatographic method.

The toner preferably has a specific surface area of from 0.5 to 8.0 $m^2/g$ which is determined by a BET method.

The toner preferably has a volume average particle diameter of from 3 to 8 μm.

The toner preferably has a ratio (Dv/Dn) of a volume average particle diameter (Dv) to a number average particle diameter (Dn) of from 1.00 to 1.25.

The toner preferably has an average circularity of from 0.90 to 1.00.

It is preferable that each of the at least two kinds of particulate resins is a resin selected from the group consisting of vinyl resins, polyurethane resins, epoxy resins, and polyester resins.

The TgA is preferably from 50 to 150° C. and TgB is preferably from 25 to 100° C.

The binder resin preferably includes a polyester resin.

The toner preferably has a minimum fixable temperature lower than 170° C. when determined by the fixability measuring method (2) specified in the specification.

As another aspect of the present invention, a method for preparing the above-mentioned toner is provided which includes:

dispersing a compound having an active hydrogen and a polymer capable of reacting the hydrogen atom of the compound in an aqueous medium including the at least two kinds of particulate resins; and reacting the polymer with the compound to prepare the toner particles which include the binder resin and on the surface of which the at least two kinds of particulate resins are present, and wherein the toner satisfies at least one of the above-mentioned relationships (1) and (2).

It is preferable that the method further includes:

treating the toner particles with a basic aqueous solution to remove a part of the at least two kinds of particulate resins, which are present on the surface of the toner particles, and to prepare the toner particles so that the at least two kinds of particulate resins are included in the toner in an amount of from 0.5 to 5.0% by weight.

It is preferable that in the dispersion step a percentage of the aqueous medium in the dispersion is from 1/6 to 20/21, and the dispersion operation is performed at a temperature of from 0 to 150° C. under pressure.

As yet another aspect of the present invention, a two component developer is provided which includes the above-mentioned toner and a carrier. The toner itself of the present invention can be used as a one component developer.

As a further aspect of the present invention, a toner container is provided which contains the above-mentioned toner.

As a still further aspect of the present invention, an image forming method is provided which includes:

forming an electrostatic latent image on an image bearing member;

developing the electrostatic latent image with the above-mentioned toner to form a toner image on the image bearing member;

transferring the toner image onto a receiving material via an intermediate transfer medium; and fixing the toner image on the receiving material.

As a still further aspect of the present invention, an image forming apparatus is provided which includes:

an image bearing member;

a charger configured to charge the image bearing member;

a latent image forming device configured to form an electrostatic latent image on the image bearing member;

a developing device configured to develop the electrostatic latent image with the toner mentioned above to form a toner image on the image bearing member;

a transferring device configured to transfer the toner image on a receiving material;

a fixing device configured to fix the toner image on the receiving material.

As a still further aspect of the present invention, a process cartridge is provided which includes:

at least a developing device configured to develop an electrostatic latent image with the toner mentioned above; and a housing.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
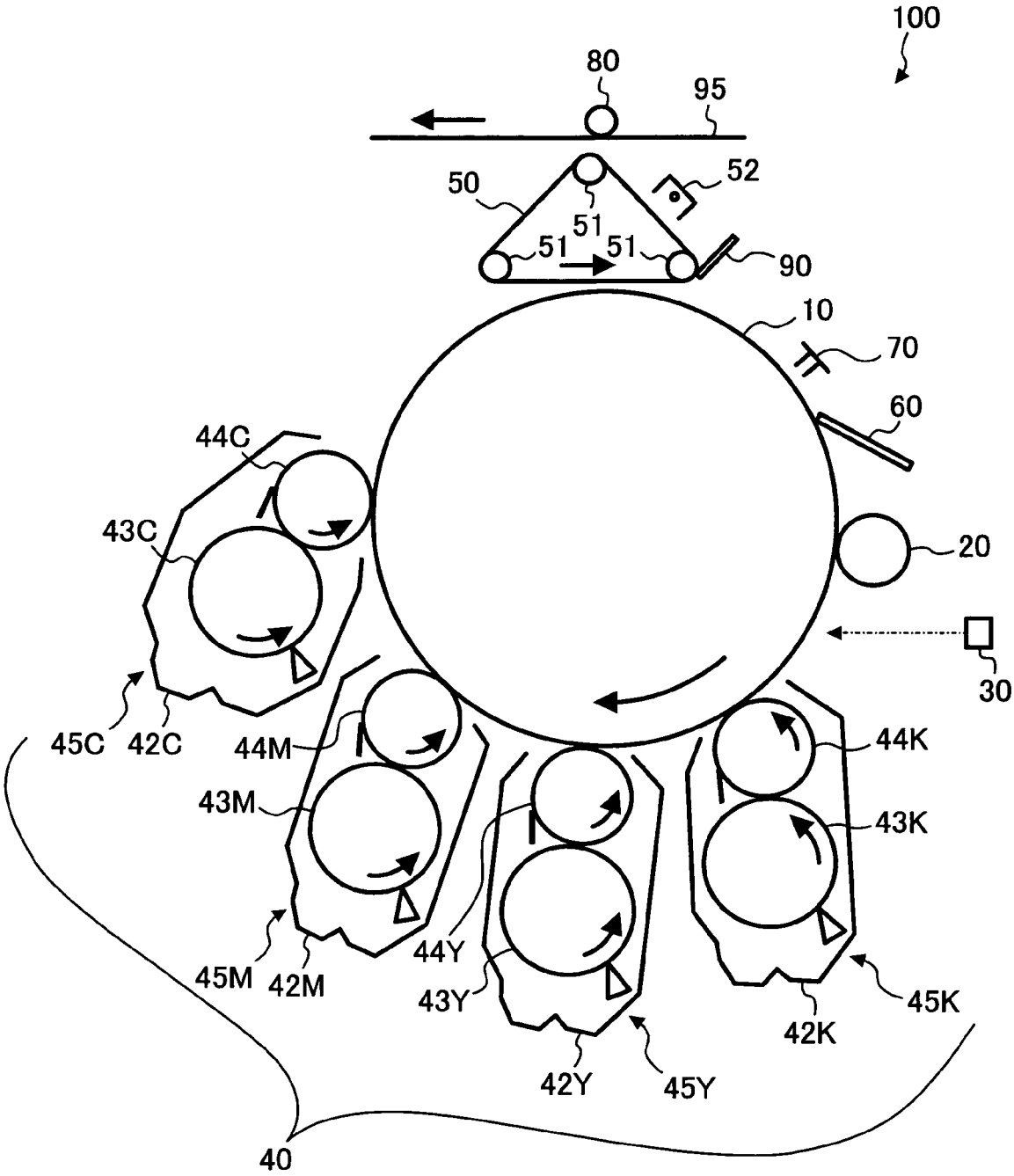
FIG. 1 is a schematic view illustrating an embodiment of the image forming apparatus of the present invention.

The toner of the present invention includes toner particles, which include at least a binder resin and at least two kinds of particulate resins which are present on at least a surface of the toner particles. The toner particles are prepared by a method including the steps of dispersing a compound having an active hydrogen and a polymer capable of reacting the hydrogen atom of the compound in an aqueous medium including the at least two kinds of particulate resins, and reacting the polymer with the compound, and wherein the at least two kinds of particulate resins satisfy at least one of the following relationships (1) and (2):

$$(TgA-TgB) \geqq 20^\circ C. \quad (1)$$

wherein TgA and TgB represent glass transition temperatures of a particulate resin (A) having a highest glass transition temperature and a particulate resin (B) having a lowest glass transition temperature among the at least two kinds of particulate resins, respectively, and $$100{,}000 \leqq Mwc \leqq 6{,}000{,}000 \text{ and } 8{,}000 \leqq Mwd \leqq 800{,}000 \quad (2)$$

wherein Mwc and Mwd represent weight average molecular weights of tetrahydrofuran-soluble components of a particulate resin (C) having a highest weight average molecular weight and tetrahydrofuran-soluble components of a particulate resin (D) having a lowest weight average molecular weight among the at least two kinds of particulate resins, respectively, wherein Mwc>Mwd.

The particulate resin (A) imparts good preservability to the toner and the particulate resin (B) imparts good low temperature fixability to the toner. Therefore, the toner has good combination of preservability and low temperature fixability while having good hot offset resistance.

The particulate resin (C) imparts good preservability to the toner and the particulate resin (D) imparts good low temperature fixability to the toner. Therefore, the toner has good combination of preservability and low temperature fixability while having good hot offset resistance.

When two kinds of particulate resins are used, the particulate resin (A) is generally the particulate resin (C) and the particulate resin (B) is the particulate resin (D). However, there is a case where the particulate resin (A) is the particulate resin (D) and the particulate resin (B) is the particulate resin (C).

The toner particles include a binder resin which is prepared by reacting a polymer with a compound having an active hydrogen in an aqueous medium. Therefore, the toner is excellent in aggregation resistance, charging properties, fluidity, transferability and fixability. Therefore, by using this toner, high quality images can be produced even under low temperature fixing conditions.

The method for manufacturing the toner of the present invention includes at least the steps of dispersing a compound having an active hydrogen and a polymer capable of reacting the hydrogen atom of the compound in an aqueous medium including the at least two kinds of particulate resins, and reacting the polymer with the compound. Therefore, the particulate resins are mainly present on the surface of the toner particles. Therefore, a toner having such good properties as mentioned above can be effectively produced.

The developer (two component developer) of the present invention includes the toner and a carrier. The toner itself of the present invention can be used as a one component developer. The developer of the present invention can produce high quality images even under low temperature fixing conditions.

The toner container contains the toner of the present invention. The toner container is set in an image forming apparatus to produce images. The images have high qualities even when fixed at a low fixing temperature.

The process cartridge of the present invention includes at least an image bearing member and a developing device configured to develop electrostatic latent images with the toner, resulting in formation of toner images on the image bearing member. The process cartridge can be detachably set in an image forming apparatus. Since the process cartridge uses the toner of the present invention, high quality images can be produced without causing the hot offset problem. In addition, images can be produced even under low temperature fixing conditions.

The image forming apparatus of the present invention includes at least an electrostatic latent image bearing member; a developing device configured to develop the latent image with the toner of the present invention to form a toner image thereon; a transfer device configured to transfer the toner image onto a receiving material optionally via an intermediate transfer medium; and a fixing device configured to fix the toner image on the receiving material. The image forming apparatus can produce high quality images even under a low temperature fixing condition.

The image forming method of the present invention includes the steps of forming an electrostatic latent image on an image bearing member; developing the latent image with the toner of the present invention to form a toner image on the image bearing member; transferring the toner image onto a receiving material optionally via an intermediate transfer medium; and fixing the toner image on the receiving material. The image forming method can produce high quality images even under a low temperature fixing condition.

Then the toner of the present invention will be explained in detail.

The toner includes toner particles which include at least a binder resin and optionally includes a colorant, a release agent, a charge controlling agent and other additives. In addition at least two kinds of particulate resins are present on the surface of the toner particles which include at least a particulate resin (A) having a highest glass transition temperature TgA and a particulate resin (B) having a lowest glass transition temperature TgB. The particulate resins (A) and (B) satisfy at least one of the following relationships:

$$(TgA-TgB) \geqq 20^\circ C. \quad (1), \text{ and}$$

$$100{,}000 \leqq Mwc \leqq 6{,}000{,}000 \text{ and } 8{,}000 \leqq Mwd \leqq 800{,}000 \quad (2).$$

Particulate Resins

The particulate resins are used such that the resultant toner has a desired particle form (circularity) and a desired particle diameter distribution, and has a good combination of low temperature fixability and preservability. It is important to use at least one kind of particulate resin which can impart good preservability, and at least one kind of particulate resin which can impart good low temperature fixability.

The difference between TgA and TgB is preferably from 20° C. to 150° C., and more preferably from 25° C. to 70° C. When the difference between TgA and TgB is too small, it becomes hard to impart a good combination of the above-mentioned properties.

The glass transition temperature TgA is preferably from 55 to 150° C. When TgA is too low, the preservability of the toner deteriorates. In contrast, when TgA is too high, the low temperature fixability deteriorates.

The glass transition temperature TgB is preferably from 25 to 100° C. When TgB is too low, the high temperature preservability of the toner deteriorates. In contrast, when TgB is too high, the low temperature fixability deteriorates.

The glass transition temperature of a resin can be measured with a TG-DSC System TAS-100 from Rigaku Corporation. The method is as follows.

(1) about 10 mg of a sample which is contained in an aluminum container is set on a holder unit, and the holder unit is set in an electric furnace;

(2) the sample is heated from room temperature to 150° C. at a temperature rising speed of 10° C./min, followed by heating at 150° C. for 10 minutes and cooling to room temperature; and (3) after the sample is allowed to settle at room temperature for 10 minutes, the sample is heated again from room temperature to 150° C. at a temperature rising speed of 10° C./min to obtain a DSC curve.

The glass transition temperature (Tg) of the sample is determined using an analyzing system of TAS-100. The glass transition temperature is defined as the temperature at which the tangent line of the endothermic curve crosses the base line.

The weight ratio (A/B) of the particulate resin (A) to the particulate resin (B) is from 10/90 to 50/50, and preferably from 20/80 to 40/60. When the weight ratio is too small, the low temperature fixability deteriorates and in addition the fixed toner images have rough surface. In contrast, when the ratio is too small, the hot offset resistance and high temperature preservability deteriorate.

The tetrahydrofuran(THF)-soluble components of the particulate resins (C) having the highest weight average molecular weight preferably have a weight average molecular weight (Mw) of from 100,000 to 6,000,000, more preferably from 300,000 to 3,000,000, and even more preferably from 500,000 to 1,000,000. When the Mw of the particulate resin (C) is too high, the hot offset resistance deteriorates.

The tetrahydrofuran(THF)-soluble components of the particulate resins (D) having the lowest weight average molecular weight preferably have a weight average molecular weight (Mw) of from 8,000 to 800,000, more preferably from 50,000 to 600,000, and even more preferably from 100,000 to 400,000. When the Mw of the particulate resin (D) is too low, the preservability deteriorates.

When a particulate resin having a broad molecular weight distribution is used, a good combination of preservability and low temperature fixability cannot be imparted to the resultant toner. This is because low molecular weight components tend to intertwine with high molecular weight components, and thereby the preservability of the toner deteriorates. In addition, high molecular weight cannot be heated to the fixable temperature in a short time and thereby the low temperature fixability deteriorates.

By using a combination of particulate resins having such different weight average molecular weights as mentioned above, the resultant toner has a good combination of preservability and low temperature fixability.

The molecular weight distribution of a resin can be measured by gel permeation chromatography (GPC). The method is as follows.

(1) the column is allowed to settle in a chamber heated to 40° C. so as to be stabilized;

(2) tetrahydrofuran (THF) is passed through the column heated to 40° C. at a flow rate of 1 ml/min;

(3) 50 to 200 μl of a 0.05 to 0.6% by weight THF solution of a sample is injected to the column to obtain a molecular distribution curve.

The molecular distribution of the sample is determined using a working curve which represents the relationship between weight and GPC counts and which is previously prepared using monodisperse polystyrenes. Specific examples of the molecular weights of the monodisperse polystyrenes include $6\times10^2$, $2.1\times10^3$, $4\times10^3$, $1.75\times10^4$, $1.1\times10^5$, $3.9\times10^5$, $8.6\times10^5$, $2\times10^6$, and $4.48\times10^6$. The monodisperse polystyrenes can be available from Pressure Chemical Co., or Tosoh Corp. It is preferable to prepare a working curve using ten or more kinds of monodisperse polystyrenes. In measurements, it is preferable to use a RI (refractive index) detector as the detector.

The volume average particle diameter of the particulate resins is preferably from 20 to 400 nm and more preferably from 30 to 350 nm. When the average particle diameter is too small, a problem in that the particulate resins on the surface of toner particles tend to form a film and thereby the toner particles are covered with the film occurs. As a result, the adhesion of the binder resin in the toner particles and receiving materials deteriorate, thereby increasing the lowest fixable temperature of the toner. In contrast, when the average particle diameter is too large, the wax included in the toner particles is prevented from exuding from the surface of the toner particles, and thereby the releasability of the toner deteriorates, resulting in occurrence of the offset problem.

The volume average particle diameter of the particulate resins is measured with an instrument LA-920 from Horiba Ltd., which uses a laser light scattering method.

The particulate resins preferably cover the surface of the toner particles at a covering rate of from 75 to 100%, and more preferably from 80 to 100%. When the covering rate is too low, the preservability deteriorates, resulting in occurrence of the blocking problem.

The covering rate can be determined by the following method:

(1) toner particles are observed and photographed using an electron microscope; and (2) the photograph is analyzed with an image analyzer to determine the covering rate.

The content of the particulate resins in the toner is preferably from 0.5 to 8.0% by weight, more preferably from 0.5 to 7.0% by weight and even more preferably from 0.5 to 5.0% by weight. When the content is too low, the preservability of the toner deteriorates, resulting in occurrence of the blocking problem when the toner is preserved or used at high temperatures. When the content is too high, the wax (release agent) included in the toner is prevented from exuding from the surface of the toner particles, resulting in occurrence of the hot offset problem.

In the present application, the content of the particulate resins is determined by the method in which a toner sample is analyzed using a pyrolysis gas chromatograph mass spectrometer to determine the amount of a material or a group specific to the particulate resins by measuring the area of a peak specific to the material or group. A mass spectrometer is preferably used as the detector.

Suitable resins for use as the particulate resins include known resins which can form an aqueous dispersion.

Specific examples thereof include thermoplastic and thermosetting resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination.

Among these resins, vinyl resins, polyurethane resins, epoxy resins and polyester resins are preferably used because an aqueous dispersion including fine spherical resin particles can be easily prepared. Specific examples of the vinyl resins include homopolymers or copolymers obtained from one or more vinyl monomers, such as styrene—(meth) acrylate copolymers, styrene—butadiene copolymers, (meth) acrylic acid—acrylate copolymers, styrene—acrylonitrile copolymers, styrene—maleic anhydride copolymers, styrene—(meth)acrylic acid copolymers, etc.

The particulate resins can be copolymers including a unit obtained from a monomer having two or more unsaturated groups. Specific examples of such monomers include sodium salts of sulfate of ethylene oxide adducts of methacrylic acid (ELEMINOL® RS-30 from Sanyo Chemical Industries Ltd.), divinyl benzene, 1,6-hexanedioldiacrylate, etc.

The particulate resins can be prepared known polymerization methods. However, it is preferable to prepare an aqueous dispersion including a particulate resin. Specific examples of the method for preparing such an aqueous dispersion are as follows.

(1) When a vinyl resin is prepared, one or more vinyl monomers are polymerized using a method such as suspension polymerization methods, emulsion polymerization methods and seed polymerization methods, resulting in preparation of an aqueous dispersion of the vinyl resin;

(2) When a polyaddition type resin or a polycondensation type resin such as polyester resins, polyurethane resins and epoxy resins is prepared, a precursor (monomer or oligomer) of the resin or a solution of the precursor is dispersed in an aqueous medium in the presence of a proper dispersant and the dispersion is heated so that the precursor be polymerized and optionally crosslinked (using a crosslinking agent), resulting in preparation of an aqueous dispersion of the resin;

(3) When a polyaddition type resin or a polycondensation type resin is prepared, a precursor (monomer or oligomer) of the resin or a solution of the precursor is mixed with an emulsifier and then water is added thereto to perform phase inversion, followed by polymerization, resulting in preparation of an aqueous dispersion of the resin;

(4) A resin prepared by a polymerization method such as addition polymerization, ring-opening polymerization and polycondensation polymerization is pulverized with a pulverizer such as mechanical rotation pulverizers and jet air pulverizers, followed by classification, resulting in preparation of a particulate resin. An aqueous dispersion can be prepared by dispersing the particulate resin in water using a proper dispersant;

(5) A resin prepared by a polymerization method such as addition polymerization, ring-opening polymerization and polycondensation polymerization is dissolved in a solvent and the solution is sprayed to prepare a particulate resin. An aqueous dispersion can be prepared by dispersing the particulate resin in water using a proper dispersant;

(6) A resin prepared by a polymerization method such as addition polymerization, ring-opening polymerization and polycondensation polymerization is dissolved in a solvent. The solution is mixed with a solvent which cannot dissolve the resin or the solution is cooled, to precipitate a particulate resin therein. After the solvent is separated from the particulate resin, and the particulate resin is dispersed in water using a proper dispersant, resulting in preparation of an aqueous dispersion;

(7) A resin prepared by a polymerization method such as addition polymerization, ring-opening polymerization and polycondensation polymerization is dissolved in a solvent and the solution is dispersed in an aqueous medium using a proper dispersant, followed by removal of the solvent, resulting in preparation of an aqueous dispersion of the resin; and (8) A resin prepared by a polymerization method such as addition polymerization, ring-opening polymerization and polycondensation polymerization is dissolved in a solvent and the solution is mixed with an emulsifier, and then water is added thereto to perform phase inversion, followed by removal of the solvent, resulting in preparation of an aqueous dispersion of the resin.

The toner of the present invention includes at least two kinds of particulate resins, but it is possible to use a combination of particulate resins which consist of the same components but have different glass transition temperatures satisfying the relationship (1) mentioned above and/or different weight average molecular weights satisfying the relationship (2).

Binder Resin

The binder resin is included in the toner to improve the adhesion of the toner to receiving materials. The binder resin includes at least a resin prepared by reacting a compound having an active hydrogen with a polymer reactive with an active hydrogen, and can optionally include one or more known binder resins.

The weight average molecular weight of the binder resin is preferably not less than 1,000, more preferably from 2,000 to 10,000,000 and even more preferably from 3,000 to 1,000,000. When the average molecular weight of the binder resin is too low, the hot offset resistance of the toner deteriorates.

The glass transition temperature (Tg) of the binder resin is preferably from 30 to 70° C., and more preferably from 40 to 65° C. The binder resin preferably includes a polyester resin which is prepared by crosslinking or extension reaction. In this case, the resultant toner has a relatively good preservability compared to toners including a conventional polyester resin even when the polyester resin has a relatively low glass transition temperature compared to that of the conventional polyester resin.

When the glass transition temperature is too low, the preservability of the toner deteriorates. In contrast, when the glass transition temperature is too high, the low temperature fixability of the toner deteriorates.

The glass transition temperature of the binder resin can be measured by the method mentioned above.

Known resins can be used as the binder resin, and one or more proper resins are chosen and used for the toner. However, polyester resins are preferably used. Among polyester resins, urea-modified polyester resins are more preferably used.

Urea-modified polyester resins are prepared by reacting an amine (i.e., a compound having an active hydrogen) with a polyester prepolymer having an isocyanate group (i.e., the polymer capable of reacting with an active hydrogen) in an aqueous medium.

The urea-modified polyester resins can include a urethane bonding. The molar ratio (U1/U2) of the urea bonding (U1) to the urethane bonding (U2) is from 100/0 to 10/90, preferably from 80/20 to 20/80 and more preferably from 60/40 to 30/70. When the content of the urea bonding is too low, the hot offset resistance of the toner deteriorates.

Specific examples of suitable urea-modified polyester resins include the following.

(1) Mixtures of a urea-modified polyester resin which is prepared by reacting a polyester prepolymer, which is prepared by reacting a polycondensation product of an ethylene oxide (2 moles) adduct of bisphenol A and isophthalic acid with isophorone diisocyanate, with isophorone diamine; and a polycondensation product of an ethylene oxide (2 moles) adduct of bisphenol A and isophthalic acid;

(2) Mixtures of a urea-modified polyester resin which is prepared by reacting a polyester prepolymer, which is prepared by reacting a polycondensation product of an ethylene oxide (2 moles) adduct of bisphenol A and isophthalic acid with isophorone diisocyanate, with isophorone diamine; and a polycondensation product of an ethylene oxide (2 moles) adduct of bisphenol A and terephthalic acid;

(3) Mixtures of a urea-modified polyester resin which is prepared by reacting a polyester prepolymer, which is prepared by reacting a polycondensation product of an ethylene oxide (2 moles) adduct of bisphenol A, a propylene oxide (2 moles) adduct of bisphenol A and terephthalic acid with isophorone diisocyanate, with isophorone diamine; and a polycondensation product of an ethylene oxide (2 moles) adduct of bisphenol A, a propylene oxide (2 moles) adduct of bisphenol A and terephthalic acid;

(4) Mixtures of a urea-modified polyester resin which is prepared by reacting a polyester prepolymer, which is prepared by reacting a polycondensation product of an ethylene oxide (2 moles) adduct of bisphenol A, a propylene oxide (2 moles) adduct of bisphenol A and terephthalic acid with isophorone diisocyanate, with isophorone diamine; and a polycondensation product of a propylene oxide (2 moles) adduct of bisphenol A and terephthalic acid;

(5) Mixtures of a urea-modified polyester resin which is prepared by reacting a polyester prepolymer, which is prepared by reacting a polycondensation product of an ethylene oxide (2 moles) adduct of bisphenol A and terephthalic acid with isophorone diisocyanate, with hexamethylene diamine; and a polycondensation product of an ethylene oxide (2 moles) adduct of bisphenol A and terephthalic acid;

(6) Mixtures of a urea-modified polyester resin which is prepared by reacting a polyester prepolymer, which is prepared by reacting a polycondensation product of an ethylene oxide (2 moles) adduct of bisphenol A and terephthalic acid with isophorone diisocyanate, with hexamethylene diamine; and a polycondensation product of an ethylene oxide (2 moles) adduct of bisphenol A, a propylene oxide (2 moles) adduct of bisphenol A and terephthalic acid;

(7) Mixtures of a urea-modified polyester resin which is prepared by reacting a polyester prepolymer, which is prepared by reacting a polycondensation product of an ethylene oxide (2 moles) adduct of bisphenol A and terephthalic acid with isophorone diisocyanate, with ethylene diamine; and a polycondensation product of an ethylene oxide (2 moles) adduct of bisphenol A and terephthalic acid;

(8) Mixtures of a urea-modified polyester resin which is prepared by reacting a polyester prepolymer, which is prepared by reacting a polycondensation product of an ethylene oxide (2 moles) adduct of bisphenol A and isophthalic acid with diphenylmethane diisocyanate, with hexamethylene diamine; and a polycondensation product of an ethylene oxide (2 moles) adduct of bisphenol A and isophthalic acid;

(9) Mixtures of a urea-modified polyester resin which is prepared by reacting a polyester prepolymer, which is prepared by reacting a polycondensation product of an ethylene oxide (2 moles) adduct of bisphenol A, a propylene oxide (2 moles) adduct of bisphenol A, terephthalic acid and dodecenyl succinic anhydride with diphenylmethane diisocyanate, with hexamethylene diamine; and a polycondensation product of an ethylene oxide (2 moles) adduct of bisphenol A, a propylene oxide (2 moles) adduct of bisphenol A and terephthalic acid; and

(10) Mixtures of a urea-modified polyester resin which is prepared by reacting a polyester prepolymer, which is prepared by reacting a polycondensation product of an ethylene oxide (2 moles) adduct of bisphenol A and isophthalic acid with tolylene diisocyanate, with hexamethylene diamine; and a polycondensation product of an ethylene oxide (2 moles) adduct of bisphenol A and isophthalic acid.

Compound Having an Active Hydrogen

The compound having an active hydrogen is used for crosslinking and/or extending the polymer capable of reacting with a compound having an active hydrogen. Namely, the compound serves as a crosslinking agent and/or an extending agent.

Known compounds having an active hydrogen can be used as the compound and one ore more proper compounds are chosen and used for the toner. For example, when an polyester prepolymer having an isocyanate group is used, amines are preferably used as the compound having an active hydrogen because the extension reaction and/or the crosslinking reaction can be easily performed and thereby a polymer having high molecular weight can be easily produced.

Specific examples of the groups having an active hydrogen include hydroxyl groups (alcoholic hydroxyl groups and phenolic hydorxyl groups), amino groups, carboxyl groups, mercapto groups, etc. Compounds having two or more of these groups can also be used, and combinations of a compound having one of the groups and another compound having another of the groups can also be used. Among these groups, alcoholic hydroxyl groups are preferable.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked. These amines can be used alone or in combination.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc.

The molecular weight of the urea-modified polyesters can be controlled using an extension inhibitor, if desired. Specific examples of the extension inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., an equivalence ratio [NCO]/[NHx]) of (the [NCO] of) the prepolymer (A) having an isocyanate group to (the [NHx] of) the amine (B) is from 1/3 to 3/1, preferably from 1/2 to 2/1 and more preferably from 1/1.5 to 1.5/1. When the mixing ratio is too low or too high, the molecular weight of the resultant urea-modified polyester decreases, resulting in deterioration of the hot offset resistance of the resultant toner.

Polymer Capable of Reacting Compound Having Active Hydrogen

Any known polymers having a group which can be reacted with a compound having an active hydrogen can be used as the polymer (hereinafter referred to as a prepolymer). Specific examples of the polymers include polyol resins, acrylic resins, polyester resins, epoxy resins, and derivatives thereof. These resins can be used alone or in combination. Among these resins, polyester resins are preferable.

Specific examples of the group of the prepolymer which can be reacted with an active hydrogen include isocyanate groups, epoxy groups, carboxyl groups, acid chloride groups, etc. Compounds having two or more of the groups and combinations of a compound having one of the groups and another compound having another of the groups can also be used. Among these groups, isocyanate groups can be preferably used.

Among the prepolymers, polyester resins (RMPE) having a group which can produce a urea bonding are preferably used because (1) the molecular weight of the resultant polymers can be easily controlled; and (2) the resultant toner can be used for oil-less low temperature fixing devices without causing the offset problem.

Specific examples of the group which can produce a urea bonding include isocyanate groups.

Polyester prepolymers having an isocyanate group can be prepared by reacting a polycondensation product of a polyol (PO) and a polycarboxylic acid (PC) with a polyisocyanate (PIC).

Suitable polyols (PO) include diols (DIO), polyols (TO) having three or more hydroxyl groups, and mixtures of DIO and TO. Preferably, diols (DIO) or mixtures of a small amount of a polyol (TO) with a diol (DIO) are used.

Specific examples of the diols (DIO) include alkylene glycols, alkylene ether glycols, alicyclic diols, alkylene oxide adducts of alicyclic diols, bisphenols, alkylene oxide adducts of bisphenols.

Suitable alkylene glycols include alkylene glycols having 2 to 12 carbon atoms, e.g., ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexane dimethanol and hydrogenated bisphenol A. Specific examples of the alkylene oxide adducts of alicyclic diols include adducts of the alicyclic diols mentioned above with an alkylene oxide (e.g., ethylene oxide, propylene oxide and butylene oxide). Specific examples of the bisphenols include bisphenol A, bisphenol F and bisphenol S. Specific examples of the the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide such as ethylene oxide, propylene oxide and butylene oxide; etc.

When mixtures of a diol (DIO) and a polyol (TO) are used, the weight ratio (DIO/TO) is preferably 100/0.01 to 100/10, and more preferably from 100/0.01 to 100/1.

Suitable polycarboxylic acids (PC) include dicarboxylic acids (DIC) and polycarboxylic acids (TC) having three or more carboxyl groups. Preferably, dicarboxylic acids (DIC) or mixtures of a small amount of a polycarboxylic acid (TC) with a dicarboxylic acid (DIC) are used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

As the polycarboxylic acid (PC), anhydrides or lower alkyl esters (e.g., methyl esters, ethyl esters or isopropyl esters) of the polycarboxylic acids mentioned above can be used for the reaction with a polyol (PO).

When combinations of a dicarboxylic acid and a polycarboxylic acid (TC) are used, the weight ratio (DIC/TC) is preferably 100/0.01 to 100/10, and more preferably from 100/0.01 to 100/1.

Suitable mixing ratio (i.e., an equivalence ratio [OH]/[COOH]) of (the [OH] of) a polyol (PO) to (the [COOH] of) a polycarboxylic acid (PC) is from 2/1 to 1/1, preferably from 1.5/1 to 1/1 and more preferably from 1.3/1 to 1.02/1. When the ratio is too high or too low, a problem in that the polycondensation reaction does not well proceed tends to occur.

The content of the polyol unit in the polyester prepolymer (A) is preferably from 0.5 to 40% by weight, more preferably from 1 to 30% by weight, and even more preferably from 2 to 20% by weight. When the content is too low, the hot offset resistance deteriorates and a good combination of preservability and low temperature fixability cannot be imparted to the toner. When the content is too high, the low temperature fixability of the toner deteriorates.

Specific examples of the polyisocyanates (PIC) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., α,α,α',α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination. Among these compounds, isophorone diisocyanate is preferable.

Suitable mixing ratio (i.e., an equivalence ratio [NCO]/[OH]) of (the [NCO] of) a polyisocyanate (PIC) to (the [OH] of) a polyester is from 5/1 to 1/1, preferably from 4/1 to 1.2/1 and more preferably from 3/1 to 1.5/1. When the [NCO]/[OH] ratio is too large, the low temperature fixability of the toner deteriorates. In contrast, when the ratio is too small, the content of the urea group in the modified polyesters decreases and thereby the hot-offset resistance of the toner deteriorates.

The content of the polyisocyanate (PIC) unit in the polyester prepolymer (A) having an isocyanate group is from 0.5 to 40% by weight, preferably from 1 to 30% by weight and more preferably from 2 to 20% by weight. When the content is too low, the hot offset resistance of the toner deteriorates and in addition a good combination of preservability and low temperature fixability cannot be imparted to the toner. In contrast, when the content is too high, the low temperature fixability of the toner deteriorates.

The number of the isocyanate group included in a molecule of the polyester prepolymer (A) is not less than 1, preferably from 1.2 to 5, and more preferably from 1.5 to 4. When the number of the isocyanate group is too small, the molecular weight of the resultant urea-modified polyester decreases and thereby the hot offset resistance deteriorate.

Aqueous Medium

The reaction of a polymer with a compound having an active hydrogen is performed in an aqueous medium.

Suitable aqueous media include water. In addition, other solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

Other Toner Constituents

The toner of the present invention can include other components such as colorants, release agents, resins (such as unmodified polyester resins) other than the above-mentioned resins, charge controlling agents, fluidity improving agents, cleanability improving agents, magnetic materials, metal soaps, external additives (such as particulate inorganic materials), etc.

1) Colorants

Known dyes and pigments can be used as the colorant of the toner of the present invention and one or more proper dyes and pigments are chosen and used for the toner.

Specific examples of the dyes and pigments include carbon black, Nigrosine dyes, black iron oxide, Naphthol Yellow S (C.I. 10316), Hansa Yellow 10G (C.I. 11710), Hansa Yellow 5G (C.I. 11660), Hansa Yellow G (C.I. 11680), Cadmium Yellow, yellow iron oxide, loess, chrome yellow, Titan Yellow, polyazo yellow, Oil Yellow, Hansa Yellow GR (C.I. 11730), Hansa Yellow A (C.I. 11735), Hansa Yellow RN (C.I. 11740), Hansa Yellow R (C.I. 12710), Pigment Yellow L (C.I. 12720), Benzidine Yellow G (C.I. 21095), Benzidine Yellow GR (C.I. 21100), Permanent Yellow NCG (C.I. 20040), Vulcan Fast Yellow 5G (C.I. 21220), Vulcan Fast Yellow R (C.I. 21135), Tartrazine Lake, Quinoline Yellow Lake, Anthrazane Yellow BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red F2R (C.I. 12310), Permanent Red F4R (C.I. 12335), Permanent Red FRL (C.I. 12440), Permanent Red FRLL (C.I. 12460), Permanent Red F4RH (C.I. 12420), Fast Scarlet VD, Vulcan Fast Rubine B (C.I. 12320), Brilliant Scarlet G, Lithol Rubine GX (C.I. 12825), Permanent Red F5R, Brilliant Carmine 6B, Pigment Scarlet 3B, Bordeaux 5B, Toluidine Maroon, Permanent Bordeaux F2K (C.I. 12170), Helio Bordeaux BL (C.I. 14830), Bordeaux 10B, Bon Maroon Light (C.I. 15825), Bon Maroon Medium (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue RS (C.I. 69800), Indanthrene Blue BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B. Naphthol Green B. Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner. When the content is too low or too high, a problem in that the image density decreases tends to occur.

Master batches, which are complexes of a colorant with a resin, can be used as the colorant of the toner of the present invention.

Specific examples of the resins for use as the binder resin of the master batches include the modified and unmodified polyester resins as mentioned above, styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

2) Release Agent

The toner of the present invention can include a wax or the like as a release agent.

Known waxes can be used for the toner of the present invention, and one or more proper waxes are chosen and used for the toner. Specific examples of the waxes include waxes having a carbonyl group; polyolefin waxes such as polyethylene waxes and polypropylene waxes; hydrocarbons having a long chain such as paraffin waxes and SASOL waxes. Specific examples of the waxes having a carbonyl group include esters of polyalkanoic acids (e.g., carnauba waxes, montan waxes, trimethylolpropane tribehenate, pentaerythritol tetrabehenate, pentaerythritol diacetate dibehenate, glycerin tribehenate and 1,18-octadecanediol distearate); polyalkanol esters (e.g., tristearyl trimellitate and distearyl maleate); polyalkanoic acid amides (e.g., ethylenediamine dibehenyl amide); polyalkylamides (e.g., trimellitic acid tristearylamide); and dialkyl ketones (e.g., distearyl ketone). Among these waxes having a carbonyl group, polyalkananoic acid esters are preferably used.

The melting point of the waxes for use in the toner of the present invention is from 40 to 160° C., preferably from 50 to 120° C., more preferably from 60 to 90° C. When the melting point of the wax used is too low, the preservability of the resultant toner deteriorates. In contrast, when the melting point is too high, the resultant toner tends to cause a cold offset problem in that a toner image adheres to a fixing roller when the toner image is fixed at a relatively low fixing temperature.

The waxes preferably have a melt viscosity of from 5 to 1000 mPa·s (i.e., 5 to 1000 cps), and more preferably from 10 to 100 mPa·s (i.e., 10 to 100 cps), at a temperature 20° C. higher than the melting point thereof. Waxes having too high a melt viscosity hardly produce offset resistance improving effect and low temperature fixability improving effect. In contrast, waxes having too low a melt viscosity deteriorates the releasability of the resultant toner.

The content of a wax in the toner of the present invention is generally from 0 to 40% by weight, and preferably from 3 to 30% by weight. When the content is too high, the fluidity of the toner deteriorates.

3) Unmodified Polyester Resin

It is preferable to use a combination of a urea-modified polyester resin with an unmodified polyester resin (UMPE) as the binder resin of the toner of the present invention. By using such a combination, the low temperature fixability of the toner can be improved and in addition the toner can produce color images having a high glossiness.

Suitable materials for use as the unmodified polyester resins (UMPE) include polycondensation products of a polyol (PO) with a polycarboxylic acid (PC). Specific examples of the polyol (PO) and polycarboxylic acid (PC) are mentioned above for use in the modified polyester resins. In addition, specific examples of the suitable polyol and polycarboxylic acid are also mentioned above.

When a combination of a modified polyester resin with an unmodified polyester resin is used as the binder resin, it is preferable that the unmodified polyester resin is at least partially mixed with the modified polyester resin to improve the low temperature fixability and hot offset resistance of the toner. Namely, it is preferable that the unmodified polyester resin has a molecular structure similar to that of the modified polyester resin.

The unmodified polyester resins for use in the toner of the present invention preferably have a weight average molecular weight (Mw) of form 1,000 to 30,000, more preferably from 1,500 to 10,000, and even more preferably from 2,000 to 8,000 when Mw is determined by a gel permeation chromatography. When the molecular weight is too low, the preservability of the toner deteriorates. When the molecular weight is too high, the low temperature fixability of the toner deteriorates.

The glass transition temperature (Tg) of the unmodified polyester resins for use in the toner of the present invention is preferably from 30 to 50° C., and more preferably from 35 to 45° C. When the glass transition temperature is too low, the preservability of the toner deteriorates. In contrast, when the the glass transition temperature is too high, the low temperature fixability of the toner deteriorates.

The unmodified polyester resins preferably have a hydroxyl value not less than 5 mgKOH/g, and more preferably from 10 to 120 mgKOH/g, and even more preferably from 20 to 80 mgKOH/g. When the hydroxyl value is too small, it is hard to impart good combination of preservability and low temperature fixability to the resultant toner.

The unmodified polyester resins preferably have an acid value of from 0 to 40 mgKOH/g, and more preferably from 0 to 30 mgKOH/g. When a resin having a high acid value is used as a binder resin, good negative charge property can be imparted to the toner.

When a modified polyester resin (RMPE) is used in combination with an unmodified polyester resin (UMPE), the mixing ratio (RMPE/UMPE) is preferably from 5/95 to 25/75, and more preferably from 10/90 to 25/75. When the added amount of the unmodified polyester resin is too large, the hot offset resistance of the toner deteriorates and in addition, it becomes impossible to impart a good combination of preservability and low temperature fixability to the toner. When the added amount of the unmodified polyester resin is too small, the glossiness of the toner images deteriorates.

4) Charge Controlling Agent

Any known charge controlling agents can be used for the toner of the present invention to control the charge properties of the toner, and one or more proper charge controlling agents are chosen and used for the toner. Specific examples of the charge controlling agent include triphenylmethane dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid and salicylic acid derivatives, etc. White or colorless charge controlling agents are preferably used for color toners such as yellow, magenta and cyan toners.

Specific examples of the marketed products of the charge controlling agents include BONTRON® P-51 (quaternary ammonium salt), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; quinacridone, azo pigments and polymers having a functional group such as a sulfonate group, a carboxyl group, a quaternary ammonium group, etc.

When a charge controlling agent is used for the toner of the present invention, the charge controlling agent can be kneaded together with a masterbatch, and the mixture is used for preparing toner particles. Alternatively, the charge controlling agent can be dissolved or dispersed in an organic solvent together with other toner constituents and the solution or dispersion is dispersed in an aqueous medium. It is possible to adhere and fix a charge controlling agent to a surface of granulated toner particles.

The content of the charge controlling agent in the toner of the present invention is changed depending on the variables such as choice of binder resin, presence of additives, and dispersion method. However, the content of the charge controlling agent is generally from 0.1 to 10 parts by weight, and preferably from 0.2 to 5 parts by weight, per 100 parts by weight of the binder resin included in the toner. When the content is too low, a good charge property cannot be imparted to the toner. When the content is too high, the charge quantity of the toner excessively increases, and thereby the electrostatic attraction between the developing roller and the toner, resulting in deterioration of fluidity and decrease of image density.

5) Particulate Inorganic Material

The toner of the present invention can include a particulate inorganic material as an internal additive and/or an external additive, to improve the fluidity of the toner. Specific examples of such materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. These inorganic materials can be used alone or in combination.

The primary particle diameter of the particulate inorganic materials for use in the toner preferably is from 5 nm to 2 μm, and more preferably from 5 nm to 500 nm. The BET surface area of the particulate inorganic materials for use in the toner preferably is from 20 to 500 $m^2/g$. The content of the particulate inorganic materials in the toner is preferably from 0.01 to 5% by weight, and more preferably from 0.01 to 2.0% by weight.

The particulate inorganic materials for use in the toner of the present invention are preferably subjected to a hydrophobizing treatment to prevent deterioration of the fluidity and charge properties of the resultant toner particularly under high humidity conditions. Suitable hydrophobizing agents for use in the hydrophobizing treatment include silicone oils, silane coupling agents, silylation agents, silane coupling agents having a fluorinated alkyl group, organic titanate coupling agents, aluminum coupling agents, etc.

6) Cleanability Improving Agent

In addition, the toner preferably includes a cleanability improving agent which can impart good cleaning property to the toner such that the toner remaining on the surface of an image bearing member such as a photoreceptor even after a toner image is transferred can be easily removed. Specific examples of such a cleanability improving agent include fatty acids and their metal salts such as stearic acid, zinc stearate, and calcium stearate; and particulate polymers such as polymethylmethacrylate and polystyrene, which are manufactured by a method such as soap-free emulsion polymerization methods.

Particulate resins having a relatively narrow particle diameter distribution and a volume average particle diameter of from 0.01 μm to 1 μm are preferably used as the cleanability improving agent.

7) Magnetic Materials

Magnetic materials such as iron powders, magnetite, and ferrite can be included in the toner of the present invention. Among these magnetic materials, white magnetic materials can be preferably used.

The physical properties such as shape and size of the toner of the present invention are not particularly limited. However, the toner preferably has the following physical properties.

The penetration of the toner is preferably not less than 15 mm, and more preferably from 20 to 30 mm when the penetration is determined by a method based on JIS K2235-1991 incorporated by reference. When the penetration is too small, the preservability of the toner deteriorates.

The method for measuring the penetration based on JIS K2235-1991 is as follows.

(1) a sample is contained in a 50 ml container;
(2) the container is allowed to settle for 20 hours in a chamber heated to 50° C.;
(3) the toner in the container is cooled to room temperature; and
(4) the toner is subjected to a penetration test in which a needle is penetrated into the toner layer at a predetermined pressure and the length of the part of the needle penetrated into the toner layer is measured.

With respect to the penetration, the larger penetration a toner has, the better preservability the toner has.

The minimum fixable temperature of the toner of the present invention is preferably as low as possible. However, in order to impart a good combination of low temperature fixability and hot offset resistance to the toner, the minimum fixable temperature is preferably lower than 170° C. and more preferably lower than 150° C.

The minimum fixable temperature is determined as follows.

(1) toner images are formed using an image forming apparatus while changing the fixing temperature;

(2) the fixed toner images are rubbed with a pad;

(3) the image densities of the images before and after the rubbing to determine the fixing rate FR:

$$FR=\{(ID2)/(ID1)\}\times 100(\%)$$

wherein ID1 represents the image density before rubbing and ID2 represents the image density after rubbing.

The minimum fixable temperature is defined as a fixing temperature below which the fixed image has a fixing rate less than 70%.

The hot offset temperature of the toner of the present invention is preferably as high as possible. However, in order to impart a good combination of low temperature fixability and hot offset resistance to the toner, the hot offset temperature is not lower than 200° C.

The hot offset temperature is determined as follows.

(1) images each including yellow, magenta, cyan, black, red, blue and green colors therein are produced using a full color image forming apparatus while changing the fixing temperature; and (2) the fixed images are carefully observed to determine whether a hot offset problem occurs.

The hot offset temperature is defined as a fixing temperature above which a hot offset phenomenon is observed in the fixed images.

The toner of the present invention preferably has the following thermal property, i.e., a softening point (Ts), a flow beginning point (Tfb) and/or a half softening point (T½).

These thermal properties can be measured using a flow tester CFT500 from Shimadzu Corp.

Specifically, the softening point (Ts) is preferably not lower than 30° C., and more preferably from 50 to 120° C. When the softening point is too low, the preservability deteriorates.

The flow beginning point (Tfb) is preferably not lower than 50° C., and more preferably from 60 to 150° C. When the flow starting point is too low, the preservability deteriorates.

The half softening point (T½) is preferably not lower than 60° C., and more preferably from 80 to 170° C. When the half softening point is too low, the preservability deteriorates.

The image density of the fixed toner images is preferably not lower than 1.90, more preferably not lower than 2.00 and even more preferably not lower than 2.10 when measured with a spectrodensitometer X-Rite 938 from X-Rite. When the image density is too low, the image has poor image quality.

In the present application, the image density is determined as follows.

(1) a solid toner image having a weight of 1.00±0.05 mg/cm$^2$ is formed on a paper TYPE 6000 <70W> using a copier IMAGIO NEO 450 from Ricoh Co., Ltd.;

(2) the toner image is fixed at a temperature of 160±2° C.; and (3) the image densities of six points of the fixed solid toner image are measured with a spectrodensitometer X-Rite 938 to obtain the average image density.

The toner of the present invention preferably has a circularity of from 0.90 to 1.00, and more preferably from 0.910 to 0.995. In addition, the content of toner particles having a circularity less than 90% is preferably not greater than 30%.

When the circularity is too small, problems in that good transferability cannot be imparted to the toner rend to occur, and/or the resultant toner images are scattered. In contrast, when the circularity is too large, a problem in that the toner particles remaining on the photoreceptor even after image transferring cannot be well removed by a blade cleaner tends to occur. Therefore, when images having a large image area proportion are produced, a background fouling problem in that the background areas of images are soiled with the remaining toner particles tends to occur. In addition, the contact charger used and other contacting members are contaminated by the toner particles, and thereby high quality images cannot be produced.

In the present application, the circularity of a toner is determined as follows using a flow-type particle image analyzer FPIA-2100 from Sysmex Corp.:

(1) a suspension including toner particles to be measured is passed through a detection area formed on a plate in the measuring instrument; and (2) the particles are optically detected by a CCD camera and then the shapes thereof are analyzed with an image analyzer.

The circularity of a particle is determined by the following equation:

$$\text{Circularity}=Cs/Cp$$

wherein Cp represents the length of the circumference of the projected image of a particle and Cs represents the length of the circumference of a circle having the same area as that of the projected image of the particle.

The toner of the present invention preferably has a volume average particle diameter of from 3 to 8 μm. When the volume average particle diameter is too small, the toner particles tend to adhere and fix on the surface of the carrier used, resulting in deterioration of the charging ability of the carrier. In addition, the toner tends to adhere and fix on the developing roller and toner layer thickness controlling blade, resulting in deterioration of image qualities. In contrast, when the volume average particle diameter is too large, high definition images cannot be produced. In addition, the particle diameter distribution of the toner in the developing device largely varies, and thereby images qualities tend to largely change.

It is preferable that the ratio (Dv/Dn) of the volume average particle diameter (Dv) of the toner to the number average particle diameter (Dn) thereof is preferably from 1.00 to 1.25, and more preferably from 1.10 to 1.25. When the ratio is too small, the toner particles tend to adhere and fix on the surface of the carrier used, resulting in deterioration of the charging ability of the carrier. In addition, the toner tends to adhere and fix on the developing roller and toner layer thickness controlling blade, resulting in deterioration of image qualities. In contrast, when the volume average particle diameter is too large, high definition images cannot be produced. In addition, the particle diameter distribution of the toner in the developing device largely varies, and thereby images qualities tend to largely change.

The volume average particle diameter (Dv), the number average particle diameter (Dn) and the ratio (Dv/Dn) can be determined using a particle diameter measuring instrument, MULTISIZER II or TA III from Beckmann-Coulter.

The toner of the present invention preferably has a BET surface area of from 0.5 to 8.0 $m^2/g$, and more preferably from 0.5 to 7.5 $m^2/g$. When the surface area is too small, the particulate resins on the surface of the toner particles tend to cover the entire surface of the toner particles, and thereby the adhesion of the binder resin in the toner particles and receiving materials is deteriorated, resulting in increase of the minimum fixable temperature. In contrast, when the surface area is too large, the release agent (such as waxes) included in the toner particles is prevented from exuding, thereby causing the offset problem.

The BET surface area can be determined using a surface area measuring instrument TRISTAR 3000 from Shimadzu Corp. The method is such that a nitrogen gas is adsorbed on the sample and the surface area is determined using a BET multi-point method.

The color of the toner is not particularly limited. When full color images are produced, black, yellow, magenta and cyan toners are preferably used. These color toners can be prepared by properly choosing one or more of the colorants mentioned above.

The toner of the present invention can be prepared by any known toner manufacturing methods. However, the toner is preferably prepared by the following method.

Toner Manufacturing Method

The toner manufacturing method includes at least the steps:

dispersing a compound having an active hydrogen and a polymer capable of reacting with the compound in an aqueous medium including at least two kinds of particulate resins; and reacting the polymer with the compound to produce toner particles including a binder resin which is the reaction product of the compound and the polymer.

The manufacturing method can include other steps.

The manufacturing method will be explained in detail. In order to prepare the toner, the following operations are performed.

(1) preparation of an aqueous phase liquid;
(2) polymerization of a polymer capable of reacting a compound having an active hydrogen;
(3) synthesis of a compound having an active hydrogen;
(4) preparation of oil phase liquid; and
(5) emulsifying/dispersing the oil phase liquid in the aqueous phase liquid.

The aqueous phase liquid is prepared by dispersing at least two kinds of particulate resins in an aqueous medium. The content of the particulate resins in the aqueous medium is not particularly limited, but the content is generally from 0.5 to 10% by weight.

The oil phase liquid is prepared by dissolving or dispersing at least the compound having an active hydrogen and the polymer reactive with the compound, optionally together with other toner constituents such as colorants, release agents, charge controlling agents and unmodified polyester resins, in an organic solvent. Alternatively, the other toner constituents can be added to the aqueous medium or added when the oil phase liquid is added to the aqueous phase liquid together with the oil phase liquid.

Specific examples of the organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, ethyl acetate, toluene, xylene, benzene, methylene chloride, 1,2-dichloroethane, chloroform and carbon tetrachloride are preferably used.

The weight ratio of the organic solvent to the toner constituents is from 40/100 to 300/100, preferably from 60/100 to 140/100 and more preferably from 80/100 to 120/100.

In the emulsifying/dispersing process, the oil phase liquid is added to the aqueous phase liquid to prepare an emulsion. In this case, the polymer (such as prepolymers having an isocyanate group) is reacted with the compound having an active hydrogen (such as amines), resulting in crosslinking and/or extension of the polymer, and thereby the binder resin is prepared. The compound having an active hydrogen can be added to the aqueous liquid when the oil phase liquid (which does not include the compound) is added to the aqueous liquid. Alternatively the compound having an active hydrogen can be previously included in the aqueous liquid or the compound can be added to an emulsion of the oil phase liquid and the aqueous phase liquid. In the latter method, the urea-modified polyester resin can be formed at the interface of the oil phase liquid and the aqueous phase liquid (i.e., the surface of the toner particles), and in addition it is possible to form concentration gradient of the polyester resin in the depth direction of the toner particles.

The reaction conditions are not particularly limited, and the conditions are determined depending on the reactivity of the compound and the polymer used. The reaction time is generally from 10 minutes to 40 hours, and preferably from 2 to 24 hours. The reaction temperature is generally from 0 to 150° C., and preferably from 40 to 98° C.

In order to prepare a stable dispersion in which the oil phase liquid including the prepolymer and other toner constituents (e.g., colorants, release agents, charge controlling agents, and unmodified polyester resins) in an aqueous medium, it is preferable to mix the oil phase liquid and the aqueous phase while applying a shearing force thereto.

The dispersing operation is not particularly limited, and known mixers and dispersing machines such as low shearing type dispersing machines, high shearing type dispersing machines, friction type dispersing machines, high pressure jet type dispersing machines and ultrasonic dispersing machine can be used.

In this case, it is preferable to prepare an emulsion including particles having an average particle diameter of from 2 to 20 μm. Therefore, high shearing type dispersing machines are preferably used.

When high shearing type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but the dispersing time is generally from 0.1 to 5 minutes. The temperature in the dispersing process is generally 0 to 150° C. (under pressure), and preferably from 40 to 98° C. The processing temperature is preferably as high as possible because the viscosity of the dispersion decreases and thereby the dispersing operation can be easily performed.

In the emulsification/dispersing process, the weight ratio of the aqueous medium to the toner constituents is generally from 50/100 to 2000/100, and preferably from 100/100 to 1000/100. When the amount of the aqueous medium is too small, the toner constituents tend not to be well dispersed, and thereby a toner having a desired particle diameter cannot be prepared. In contrast, to use a large amount of aqueous medium is not economical.

A dispersant can be used for the emulsification/dispersion process to prepare toner particles having a sharp particle diameter distribution and to prepare a stable emulsion/dispersion.

Suitable dispersants include surfactants, inorganic dispersants which are hardly soluble in water, polymer protection colloids, etc. These dispersants can be used alone or in combination. Among these dispersants, surfactants are preferably used.

Surfactants are generally classified into anionic surfactants, cationic surfactants, nonionic surfactants, and ampholytic surfactants.

Suitable anionic surfactants include alkylbenzene sulfonic acid salts, α-olefin sulfonic acid salts, and phosphoric acid salts. It is preferable to use fluorine-containing surfactants.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, monoperfluoroalkyl(C6-C16) ethylphosphates, etc.

Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Suitable cationic surfactants include amine salt based surfactants and quaternary ammonium salt based surfactants.

Specific examples of the amine salt based surfactants include alkyl amine salts, aminoalcohol fatty acid derivatives, polyamine fatty acid derivatives and imidazoline.

Specific examples of the quaternary ammonium salt based surfactants include alkyltrimethyl ammonium salts, dialkyldimethyl ammonium salts, alkyldimethyl benzyl ammonium salts, pyridinium salts, alkyl isoquinolinium salts and benzethonium chloride. It is preferable to use fluorine-containing cationic surfactants.

Specific examples of the cationic surfactants having a fluoroalkyl group include primary, secondary and tertiary aliphatic amino acids having a fluoroalkyl group, perfluoroalkyl(C6-C10)sulfoneamidepropyltrimethylammonium salts, benzalkonium salts, benzetonium chloride, pyridinium salts, imidazolinium salts, etc.

Specific examples of the marketed products thereof include SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Suitable nonionic surfactants include fatty acid amide derivatives, and polyhydric alcohol derivatives.

Suitable ampholytic surfactants include alanine, dodecyldi(aminoethyl)glycin, di(octylaminoethyle)glycin, and N-alkyl-N,N-dimethylammonium betaine.

Suitable inorganic dispersants include tricalcium phosphate, calcium carbonate, titanium oxide, colloidal silica, hydroxyapatite, etc.

Suitable polymer protection colloids include homopolymers and copolymers of acids, acrylic monomers having a hydroxyl group, vinyl alcohol and ethers of vinyl alcohol, esters of vinyl alcohol and compounds having a carboxyl group, amides and methylol compounds thereof, chlorides, and monomers having a nitrogen atom; polyoxyethylene compounds; and cellulose compounds.

Specific examples of the acids include acrylic acid, methacrylic acid, α-cyanoacrylic acid, α-cyanomethacrylic acid, itaconic acid, crotonic acid, fumaric acid, maleic acid and maleic anhydride. Specific examples of the acrylic monomers having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide. Specific examples of the vinyl alcohol and its ethers include vinyl methyl ether, vinyl ethyl ether and vinyl propyl ether. Specific examples of the esters of vinyl alcohol with a compound having a carboxyl group include vinyl acetate, vinyl propionate and vinyl butyrate. Specific examples of the acrylic amides include acrylamide, methacrylamide, diacetoneacrylamide and their methylol compounds. Specific examples of the chlorides include acrylic acid chloride and methacrylic acid chloride. Specific examples of the monomers having a nitrogen atom or an alicyclic ring having a nitrogen atom include vinyl pyridine, vinyl pyrrolidone, vinyl imidazole and ethylene imine.

Specific examples of the polyoxyethylene compounds include polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters. Specific examples of the cellulose compounds include methyl cellulose, hydroxyethyl cellulose and hydroxypropyl cellulose.

In the emulsification/dispersion process, a dispersion stabilizer can be used if desired. Specific examples of the dispersion stabilizers include compounds which are soluble in acids and alkalis, such as calcium phosphate.

When such compounds are used as a dispersion stabilizer, the resultant toner particles are preferably mixed with an acid such as hydrochloric acid, followed by washing with water to remove calcium phosphate from the toner particles. In addition, calcium phosphate can be removed using a zymolytic method.

In the emulsification/dispersion process, a known catalyst can optionally be used for crosslinking and/or extending the prepolymer. Specific examples of the catalyst include dibutyltin laurate and dioctyltin laurate.

In order to remove an organic solvent from the thus prepared emulsion, a method in which the emulsion is gradually heated to perfectly evaporate the organic solvent included in the drops of the oil phase liquid can be used. Alternatively, a method in which the emulsion is sprayed in a dry environment to dry the organic solvent in the drops of the oil phase liquid and water in the dispersion, resulting in formation of toner particles, can be used.

The dry environment can be formed by heating gases of air, nitrogen, carbon dioxide, combustion gas, etc., preferably, to a temperature not lower than the boiling point of the solvent having the highest boiling point among the solvents used in the emulsion. Toner particles having desired properties can be rapidly prepared by performing this treatment using a spray dryer, a belt dryer, a rotary kiln, etc.

When the organic solvent is removed, toner particles are formed. The thus prepared toner particles are washed and dried. In this case, the dispersant used is preferably removed from the toner particles. When the thus prepared toner particles have a wide particle diameter distribution even after the particles are subjected to a washing treatment and a drying treatment, the toner particles are preferably subjected to a classification treatment using a cyclone, a decanter or a classifier utilizing centrifuge to remove fine particles therefrom. In this case, it is preferable to perform the classification operation in the liquid having the particles in view of efficiency. Toner particles having a particle diameter falling out of the predetermined range can be reused for the emulsification/dispersion process.

The thus prepared toner particles can be mixed with one or more other particulate materials such as colorants, release agents, charge controlling agents, and fluidizers optionally upon application of mechanical impact thereto to fix the particulate materials on the toner particles.

Suitable mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

In the step in which a part of the at least two kinds of particulate resins is removed, at least one of the at least two kinds of particulate resins is not removed.

The thus prepared toner particles are preferably washed. In this regard, it is preferable that the toner particles are washed using a basic aqueous solution so that the content of the particulate resins in the toner particles is from 0.5 to 5.0% by weight.

Suitable solutions for use as the basic aqueous solution include sodium hydroxide solutions, potassium hydroxide solutions, barium hydroxide solutions, and strontium hydroxide solutions.

The basic aqueous solution is generally added in an amount such that the equivalence ratio [OH]/[COOH] of [OH] of the basic solution to [COOH] of the toner particles (i.e., total acid value of the toner particles) is from 0.5 to 1.5, and preferably from 0.8 to 1.2. When the equivalence ratio is too small, the particulate resins are insufficiently removed. In contrast, when the ratio is too large, a problem in that the toner particles are damaged tends to occur.

The washing method is not particularly limited, and a proper washing machine is chosen while considering the properties of the toner particles and the particulate resins.

Specific examples of the washing machines include TK HOMOMIXER from Tokushu Kika Kogyo K.K.

After the washing process, the toner particles are dried. Known drying methods for use in drying toner particles can be used for the toner particles of the present invention.

Developer

The developer of the present invention includes at least the toner of the present invention, and optionally includes a carrier and other components. The developer of the present invention can be a one component developer or a two component developer. When the developer is used for high speed image forming apparatus, two component developers are preferably used because of having long life.

When the toner is used as a one component developer, the developer has the following advantages.

(1) even when the developer is used for a long time while the developer (toner) is replenished, the particle diameter distribution of the developer hardly changes; and (2) even when the developer is used for a long time, the developer does not cause a problem in that the developer is adhered and fixed to the developing roller and developer layer forming blade used.

Therefore images having good image qualities can be produced.

When the toner is used for the two component developer, the developer has the following advantages.

(1) even when the developer is used for a long time while the toner is replenished, the particle diameter distribution of the toner hardly changes; and (2) even when the developer is agitated in the developing device, the developer can maintain good developing ability.

Therefore images having good image qualities can be produced.

The carrier for use in the two component developer of the present invention is not particularly limited, and one or more proper carriers are chosen while considering the usage of the developer. However, it is preferable to use a carrier in which a core material is coated with a resin.

Suitable materials for use as the core material include manganese-strontium materials and manganese-magnesium materials, which have a saturation magnetization of from 50 to 90 $Am^2/kg$ (90 emu/g). In view of image density, iron powders (having a a saturation magnetization not less than 100 $Am^2/kg$ (100 emu/g) and magnetite having a saturation magnetization of from 75 to 120 $Am^2/kg$ (75 to 120 emu/g) are preferably used. In addition, copper-zinc materials having a saturation magnetization of from 30 to 80 $Am^2/kg$ (30 to 80 emu/g) can be preferably used because the impact of the magnetic brush against the photoreceptor is relatively weak and high quality images can be produced.

These carrier materials can be used alone or in combination.

The core material of the carrier preferably has a volume average particle diameter ($D_{50}$) of from 10 to 150 μm, and more preferably from 40 to 100 μm. When the volume average particle diameter is too small, a carrier scattering problem tends to occur because the particles have weak magnetization. When the particle diameter is too large, the surface area of the carrier per unit weight decreases and thereby a toner scattering problem tends to occur. In addition, another problem in that uneven solid images are formed tends to occur.

Specific examples of such resins to be coated on the carriers include amino resins, vinyl or vinylidene resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, silicone resins, epoxy resins.

Specific examples of the amino resins include urea-formaldehyde resins, melamine resins, benzoguanamine resins, urea resins, and polyamide resins. Specific examples of the vinyl or vinylidene resins include acrylic resins, polymethylmethacrylate resins, polyacrylonitirile resins, polyvinyl acetate resins, polyvinyl alcohol resins, polyvinyl butyral resins, etc. Specific examples of the polystyrene resins include polystyrene resins and styrene-acrylic copolymers. Specific examples of the halogenated olefin resins include polyvinyl chloride resins. Specific examples of the polyester resins include polyethyleneterephthalate resins and polybutyleneterephthalate resins.

If desired, an electroconductive powder can be included in the resin layer of the carrier. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the coating layer.

The resin layer can be formed by coating a resin solution which is prepared by dissolving a resin in a solvent on a core material using any known coating method, followed by drying and baking. Suitable coating methods include dip coating methods, spray coating methods, brush coating methods, etc.

Specific examples of the solvent include toluene, xylene, methyl ethyl ketone, methyl isobutyl ketone, cellosolve butyl acetate, etc.

The method for baking is not particularly limited, and external heating methods and internal heating methods can be used. For example, methods using a heating device such as fixed electric furnaces, fluid electric furnaces, rotary electric furnaces, and burner furnaces, and methods using microwave, are preferably used.

The coated amount of the resin is preferably 0.01 to 5.0% by weight based on the weight of the carrier. When the coated amount is too small, a uniform resin layer cannot be formed. When the coated amount is too large, the carrier particles aggregates, and thereby the toner cannot be uniformly charged.

The weight ratio of the toner to the carrier in the two component developer is from 10/90 to 2/98, and preferably from 7/93 to 3/97.

The developer of the present invention can be used for known dry developing methods such as magnetic one component developing methods, nonmagnetic one component developing methods, two component developing methods, etc.

By using the developer of the present invention, high quality images having good fixing property can be stably produced.

Toner Container

The toner container of the present invention contains the toner of the present invention. The container is not particularly limited, and a proper container is used depending on the image forming apparatus for which the toner is used.

The shape of the toner container is not particularly limited, and cylindrical containers, etc. can be used. The containers can include a spiral groove to smoothly discharge the toner therein when rotated. Containers with a groove which can be folded like accordion can be preferably used.

Suitable materials for use as the toner container include resins having good dimension stability. Specific examples thereof include polyester resins, polyethylene resins, polypropylene resins, polystyrene resins, polyvinyl chloride resins, acrylic resins, polycarbonate resins, ABS resins, polyacetal resins, etc.

The toner container of the present invention is used by being detachably set in image forming apparatus.

(Image Forming Apparatus and Image Forming Method)

Then the image forming apparatus and image forming method will be explained in detail referring to drawings.

The image forming apparatus of the present invention includes at least an image bearing member, an electrostatic latent image forming device, a developing device, a transferring device, and a fixing device, and optionally includes a discharger (a quencher), a cleaner, a toner recycling device, a controller and other devices.

The image forming method of the present invention includes at least an electrostatic latent image forming step, a developing step, an image transferring step, and a fixing step, and optionally includes a discharging step, a cleaning step, and a toner recycling step.

Then each of the devices and steps will be explained.

(1) Latent Image Forming Process and Image Bearing Member

In the latent image forming process, an electrostatic latent image is formed on an image bearing member.

The image bearing member (hereinafter sometimes referred to as a photoconductive insulator or photoreceptor) for use in the image forming apparatus of the present invention is not particularly limited with respect to the constitution materials, shape, size, etc. Namely, known image bearing members can be used. Among the image forming members, drum-form photoreceptors including a photosensitive material such as inorganic photosensitive materials (e.g., amorphous silicon and selenium) and organic photosensitive materials (e.g., polysilane, phthalopolymethine, organic photoconductors, combinations of charge generation materials and charge transporting materials, etc.) are preferably used. Among these photosensitive materials, amorphous silicon is preferably used because of having long life.

In the latent image forming process, an electrostatic latent image is formed by uniformly charging the entire surface of a photoreceptor using a charger, and irradiating the charged photoreceptor with imagewise light using an light irradiator.

Charging is performed by applying a voltage to the photoreceptor using a charger. Known chargers can be used for charging the photoreceptor. For example, contact chargers having a semi-conductive charging element such as rollers, brushes, films and rubber blades; and non-contact chargers such as corotrons and scorotrons can be used.

Image irradiation is performed by irradiating the charged photoreceptor with imagewise light using a light irradiating device. Known light irradiators can be used and a proper light irradiator is chosen and used for the image forming apparatus for which the toner of the present invention is used. Specific examples thereof include optical systems for use in reading images in copiers; optical systems using rod lens arrays; optical systems using laser; and optical systems using a liquid crystal shutter.

It is possible to irradiate the photoreceptor from the backside of the photoreceptor.

(2) Developing Process and Image Developing Device

In the developing process, the electrostatic latent image formed above is developed with the toner (or the developer) of the present invention mentioned above to visualize the electrostatic latent image using a developing device.

Known developing devices can be used in the image forming apparatus of the present invention as long as the toner (or the developer) of the present invention can be used therefor. For example, developing devices containing the toner or developer therein and having a developing element which supplies the toner to the photoreceptor while contacting or non-contacting the photoreceptor can be used. The developing device preferably has the toner container mentioned above.

The developing device is a dry developing device which includes one or more developing sections to develop one or more color images. The developing device includes an agitator configured to agitate the toner or developer to charge the toner, and a developer bearing member bearing the toner or developer to supply the toner to the photoreceptor.

In the developing device, the toner and a carrier are agitated so that the toner is charged. The toner and carrier are then fed to the developer bearing member and form a magnetic brush on the surface of the developer bearing member. The toner in the magnetic brush is electrostatically attracted by the electrostatic latent image, resulting in transferring of the toner to the latent image. Thus, the latent image is developed with the toner, resulting in formation of a toner image.

The developer contained in the developing device may be a one-component developer which includes the toner of the present invention and does not include a carrier, or a two-component developer which includes the toner of the present invention and a carrier (i.e., the two-component developer of the present invention).

(3) Transferring Process and Image Transferring Device

In the transferring process, the toner image formed above is transferred to a receiving material optionally via an intermediate transfer medium. When multiple color images and full color images are formed using two or more color toners, it is preferable that plural color toner images are transferred to an intermediate transfer medium one by one (first transfer process), and the plural toner images on the intermediate transfer medium is transferred to a receiving material at the same time (second transfer process).

It is preferable that toner images are transferred while applying a voltage to the image bearing member and/or the transferring element. When an intermediate transfer medium is used, the transferring device includes a first transferring member which transfers the toner image on the photoreceptor to the intermediate transfer medium and a second transferring member which transfers the toner image on the intermediate transfer medium to a receiving material.

The intermediate transfer medium is not particularly limited, and known intermediate transfer media can be used. Specific examples thereof include belt-form intermediate transfer media.

Suitable transferrers for use in the (first and second) transferring members to easily transfer the toner images to a receiving material include corona discharging transferrers, transfer belts, transfer rollers, pressure transfer rollers, adhesive transferrers.

The receiving material is not particularly limited and known receiving materials can be used.

(4) Fixing Process and Fixing Device

In the fixing process, the toner image transferred to a receiving material is fixed using a fixing device. When plural toner images are transferred, the fixing operation can be made to each of the toner images transferred on the receiving material one by one, or all the toner images transferred on the receiving material at the same time.

The fixing device is not particularly limited, and a proper fixing device is chosen and used for the image forming apparatus for which the toner of the present invention is used. Suitable fixing devices include heat fixing devices which heat toner images while applying a pressure thereto. Specific examples thereof include combinations of a heat roller and a pressure roller, and combinations of a heat roller, a pressure roller and an endless belt.

When a heat fixing device is used, the fixing temperature is preferably from 80 to 200° C.

It is possible to use a fixing device which fixes toner images using light.

(5) Discharging (Quenching) Process and Discharging Device

In the discharging process, charges remaining on the photoreceptor even after the toner image thereon is transferred from the photoreceptor to a receiving material are discharged by applying a bias voltage to the photoreceptor or irradiating the photoreceptor with light, using a discharging device.

Known discharging devices can be used. Specific examples thereof include discharging lamps.

(6) Cleaning Process and Cleaning Device

In the cleaning process, toner particles remaining on the surface of the photoreceptor even after the toner image thereon is transferred on a receiving material are removed therefrom using a cleaning device.

Known cleaners can be used as the cleaning device. Specific examples thereof include magnetic brush cleaners, electrostatic brush cleaners, magnetic roller cleaners, blade cleaners, brush cleaners, and web cleaners.

(7) Toner Recycling Process and Recycling Device

In the toner recycling process, the toner collected by the cleaners are returned to the developing device using a recycling device to be reused for developing electrostatic latent images.

Known powder feeding devices can be used as the recycling device.

(8) Controlling Process and Controller

The above-mentioned processes are controlled by a controller such as sequencers, and computers.

The image forming processes and image forming apparatus will be explained in detail referring to drawings.

FIG. 1 is a schematic view illustrating an embodiment of the image forming apparatus of the present invention.

In FIG. 1, an image forming apparatus 100 includes a photoreceptor drum 10 (hereinafter referred to as a photoreceptor 10) serving as the image bearing member; a charging roller 20 serving as the charging device; a light irradiator 30 serving as the latent image forming device; a developing device 40 serving as the image developing device; an intermediate transfer medium 50; a cleaner 60 serving as the cleaning device and including a cleaning blade; and a discharging lamp 70 serving as the discharging device.

The intermediate transfer medium 50 is an endless belt which is rotated in a direction indicated by an arrow by three rollers 51 arranged therein while tightly stretched by the rollers. At least one of the three rollers 51 applies a transfer bias (first transfer bias) to the intermediate transfer medium 50. A cleaner 90 is provided to clean the surface of the intermediate transfer medium 50.

On the upper side of the intermediate transfer medium 50, a transfer roller 80 is provided which applies a transfer bias (a second transfer bias) to a receiving material 95 on which a toner image is to be transferred. In addition, a corona charger 52 is provided to charge the toner image on the intermediate transfer medium 50 before the toner image is transferred to the receiving-material 95.

A developing device 40 includes a black developing unit 45K; a yellow developing unit 45Y; a magenta developing unit 45M; and a cyan developing unit 45C. Each of the developing units includes a developer containing portion 42 (42K, 42Y, 42M or 42C), a developer supplying roller 43 (43K, 43Y, 43M or 43C), and a developing roller 44 (44K, 44Y, 44M or 44C).

In the image forming apparatus 100, the surface of the photoreceptor 10 is uniformly charged with the charging roller 20. The light irradiator 30 irradiates the charged surface of the photoreceptor 10 with imagewise light to form an electrostatic latent image on the photoreceptor 10. The developing device 40 develops the latent image with color toners, each of which is the toner of the present invention, to sequentially form color toner images on the photoreceptor 10. The color toner images are transferred to the intermediate transfer medium 50 (first transfer) to for a toner image (e.g., a full color toner image) while at least one of the rollers 51 applies a transfer bias thereto. The toner image formed on the intermediate transfer medium 50 is then transferred to the receiving material 95 (second transfer). Toner particles remaining on the photoreceptor 10 are removed with the cleaner 60 and charges remaining on the photoreceptor 10 are removed by irradiating the photoreceptor 10 with light using the discharging lamp 70.

The image forming operations will be explained referring to FIG. 2.

Figure 2:
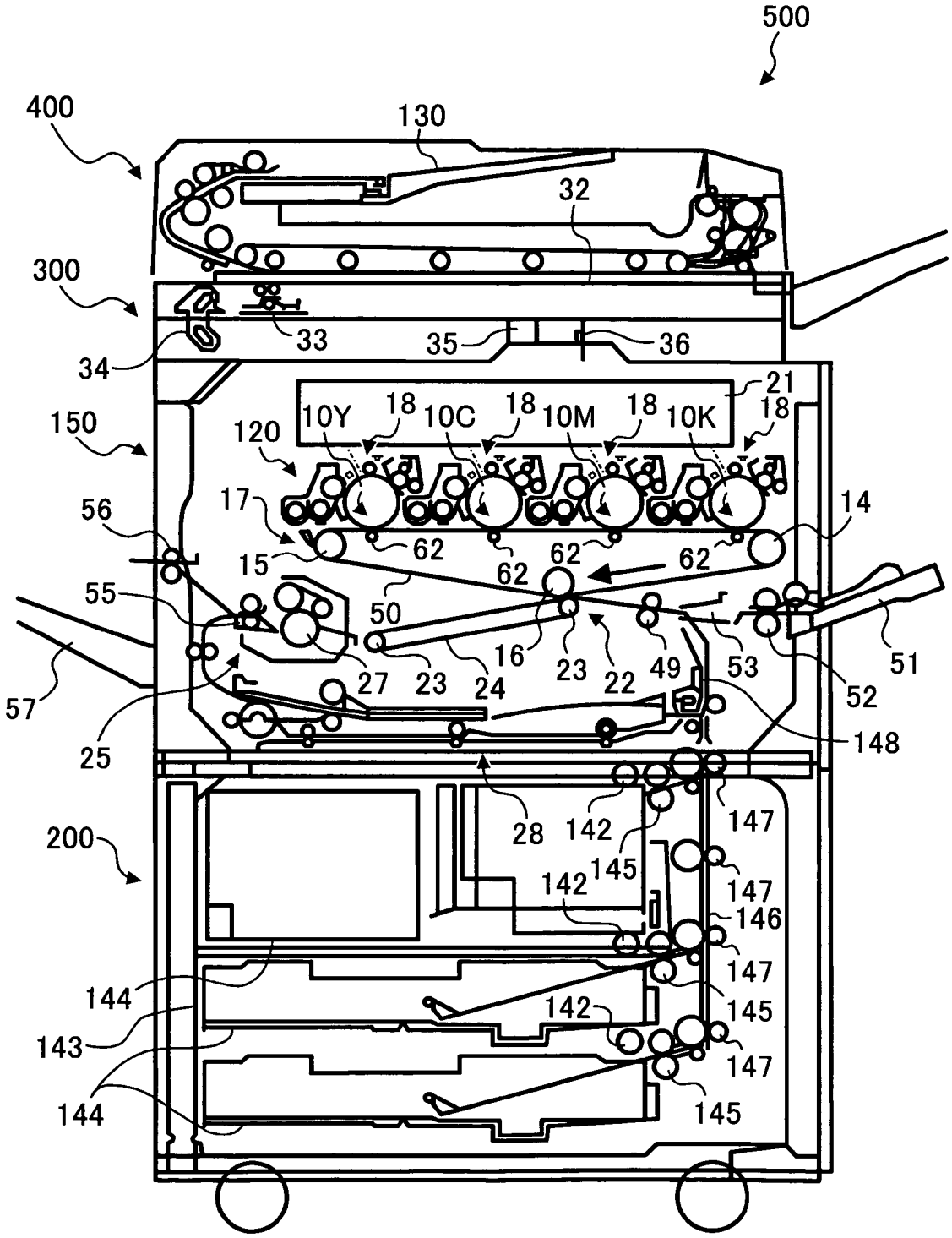
FIG. 2 is a schematic view illustrating another embodiment of the image forming apparatus of the present invention.

FIG. 2 is the overview of an embodiment of the image forming apparatus of the present invention, which is a tandem-type color image forming apparatus.

In FIG. 2, a tandem-type color image forming apparatus 500 includes an image forming section 150, a paper feeding section 200, a scanner 300 and an automatic document feeder 400.

The image forming section 150 includes an endless intermediate transfer medium 50 which is provided in the center of the image forming section 150. The intermediate transfer medium 50 is rotated in the clockwise direction by rollers 14, 15 and 16 while tightly stretched by the rollers. A cleaner 17 is provided near the roller 15 to remove toner particles remaining on the surface of the intermediate transfer medium.

Four image forming units 18 for forming yellow, magenta, cyan and black toner images are arranged side by side on the intermediate transfer medium 50. The image forming units 18 include respective photoreceptors 10Y, 10M, 10C and 10K. Numeral 120 denotes a tandem type developing device. The developing device 120 includes four developing devices arranged in the respective four image forming units 18. A light irradiator 21 is arranged at a location over the image forming units 18.

A second transfer device 22 is provided below the intermediate transfer medium 50. The second transfer device 22 includes an endless belt 24 which is rotatably stretched a pair of rollers 23. The endless belt 24 feeds a receiving material so that the toner images on the intermediate transfer medium 50 are transferred to the receiving material while sandwiched by the intermediate transfer medium 50 and the endless belt 24.

A fixing device 25 is arranged at a position near the second transfer device 22. The fixing device 25 includes an endless fixing belt 26 and a pressure roller 27 which presses the fixing belt 26.

In addition, a sheet reversing device 28 configured to reverse the receiving material is provided at a position near the fixing device 25, to produce double-sided copies.

Then the full color image forming operation using the tandem-type color image forming apparatus 500 will be explained.

An original to be copied is set on an original table 130 of the automatic document feeder 400. Alternatively, the original is directly set on a glass plate 32 of the scanner 300 after the automatic document feeder 400 is opened, followed by closing of the automatic document feeder 400. When a start button (not shown) is pushed, the color image on the original on the glass plate 32 is scanned with a first traveler 33 and a second traveler 34 which move in the right direction. In the case where the original is set on the table 130 of the automatic document feeder 400, at first the original is fed to the glass plate 32, and then the color image thereon is scanned with the first and second travelers 33 and 34. The first traveler 33 irradiates the color image on the original with light and the second traveler 34 reflects the light reflected from the color image to send the color image light to a sensor 36 via a focusing lens 35. Thus, color image information (i.e., black, yellow, magenta and cyan color image data) is provided.

The black, yellow, magenta and cyan color image data are sent to the respective black, yellow, magenta and cyan color image forming units 18, and black, yellow, magenta and cyan color toner images are formed on the respective photoreceptors 10K, 10Y, 10M and 10C. The toner image forming operation is the same as that mentioned in the image forming apparatus illustrated in FIG. 1.

Figure 3:
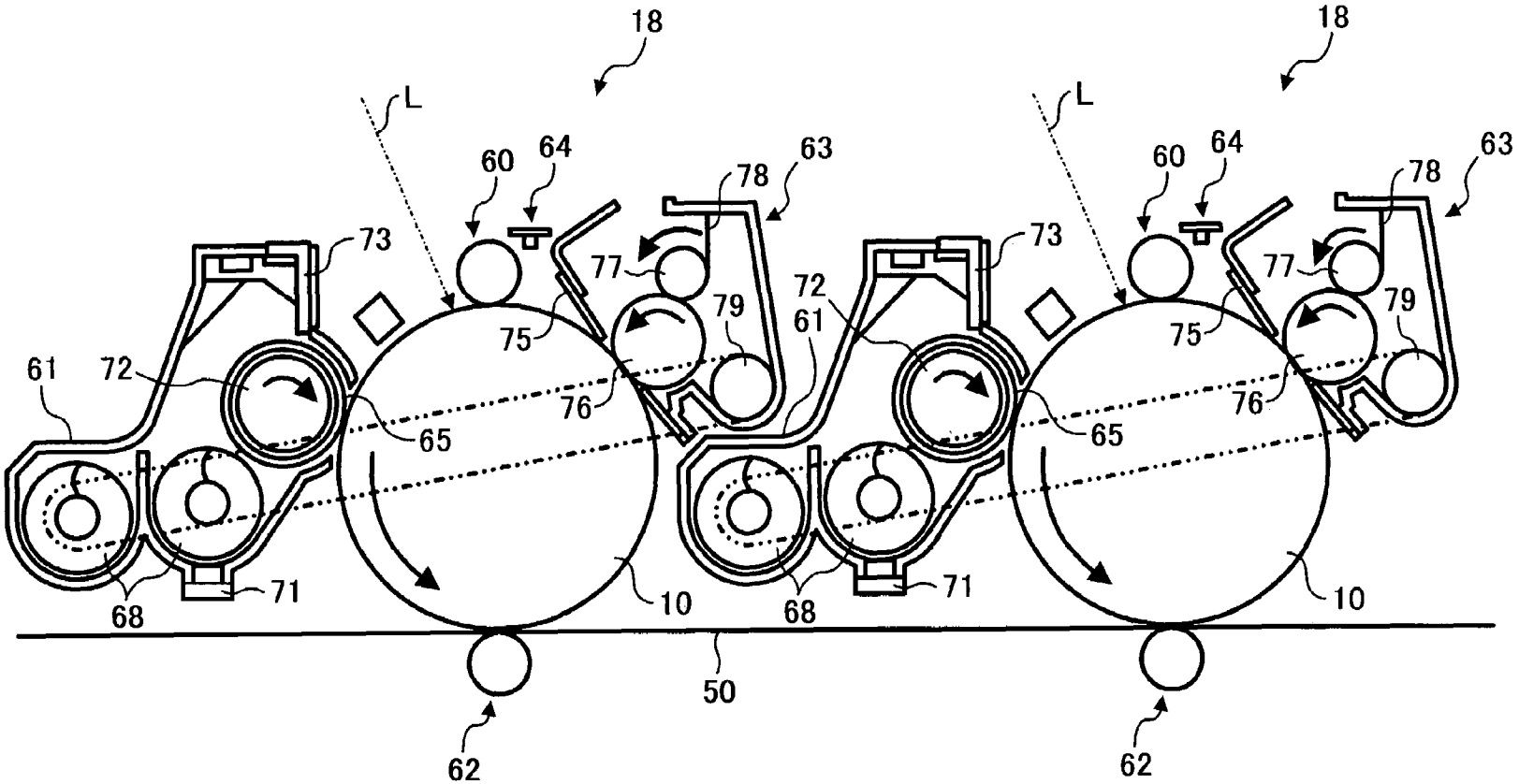
FIG. 3 is a schematic view illustrating the image forming section of the image forming apparatus illustrated in FIG. 2.

FIG. 3 is a schematic view illustrating a part of the image forming units 18.

Numeral 60, 61, 62, 63 and 64 denote a charger, a developing device, a transfer roller, a cleaner and a discharger.

The developing device 61 includes agitators 68, a developing roller 72, and a regulating blade 73 configured to forming a developer layer 65 on the surface of the developing roller. Numeral 71 denotes a toner sensor configured to determine the toner concentration. Character L denotes imagewise light.

The cleaner 63 includes cleaning blade 75, a cleaning brush 76, a roller 77, a blade 78 and a toner recycling device 79 configured to feed the collected toner particles to the developing device 61.

Referring back to FIG. 2, the thus prepared black, yellow, magenta and cyan color toner images are transferred one by one to the intermediate transfer medium 50 which is rotated by the rollers 14, 15 and 16, resulting in formation of a full color toner image on the intermediate transfer medium 50. Numeral 62 denotes a transfer charger.

On the other hand, one of paper feeding rollers 142 is selectively rotated to feed the top paper sheet of paper sheets stacked in a paper cassette 144 in a paper bank 143 while the paper sheet is separated one by one by a separation roller 145 when plural paper sheets are continuously fed. The paper sheet is fed to a passage 148 in the image forming section 150 through a passage 146 in the paper feeding section 200, and is stopped once by a registration roller 49.

Numeral 147 denotes feed rollers. A paper sheet can also be fed from a manual paper tray 51 to a passage 53 by a separation roller 52. The thus fed paper sheet is also stopped once by the registration roller 49. The registration roller 49 is generally grounded, but a bias can be applied thereto to remove paper dust therefrom.

The thus prepared full color toner image on the intermediate transfer medium 50 is transferred to the paper sheet, which is timely fed by the registration roller 49, at the contact point of the second transfer device 22 and the intermediate transfer medium 50. Toner particles remaining on the surface of the intermediate transfer medium 50 even after the second image transfer operation are removed therefrom by the cleaner 17.

The paper sheet having the full color toner image thereon is then fed by the second transfer device 22 to the fixing device 25, and the toner image is fixed on the paper sheet upon application of heat and pressure. Then the paper sheet is discharged from the image forming section 150 by a discharge roller 56 while the path is properly selected by a paper path changing pick 55. Thus, a copy is stacked on a tray 57. When a double sided copy is produced, the paper sheet having a toner image on one side thereof is fed to the sheet reversing device 28 to be reversed. Then the paper sheet is fed to the second transfer device 24 so that an image is transferred to the other side of the paper sheet. The image is also fixed by the fixing device 25 and then the copy is discharged to the tray 57 by the discharge roller 56.

Then the process cartridge of the present invention will be explained.

The process cartridge of the present invention includes at least a developing device configured to develop electrostatic latent images with the toner of the present invention and a housing, and optionally includes one or more devices selected from photoreceptors, chargers, and cleaners.

Figure 4:
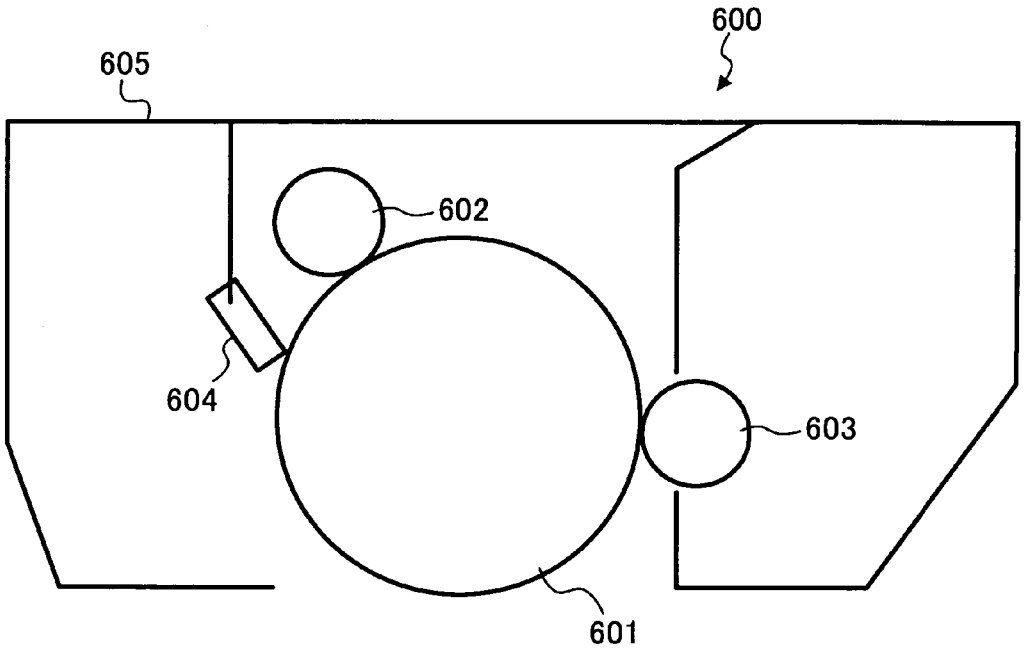
FIG. 4 is a schematic view illustrating an embodiment of the process cartridge of the present invention.

FIG. 4 is a schematic view illustrating an embodiment of the process cartridge of the present invention.

Numeral 600 denotes the process cartridge. The process cartridge 600 includes a photoreceptor 601, a charger 602, a developing device 603, a cleaner 604 and a housing 605.

The process cartridge 600 can be detachably set in an image forming apparatus such as copiers and printers.

The image forming apparatus including such a process cartridge can perform image forming operations similar to those mentioned above (i.e., charging, irradiating, developing, transferring, fixing, cleaning, etc.).

Figure 5:
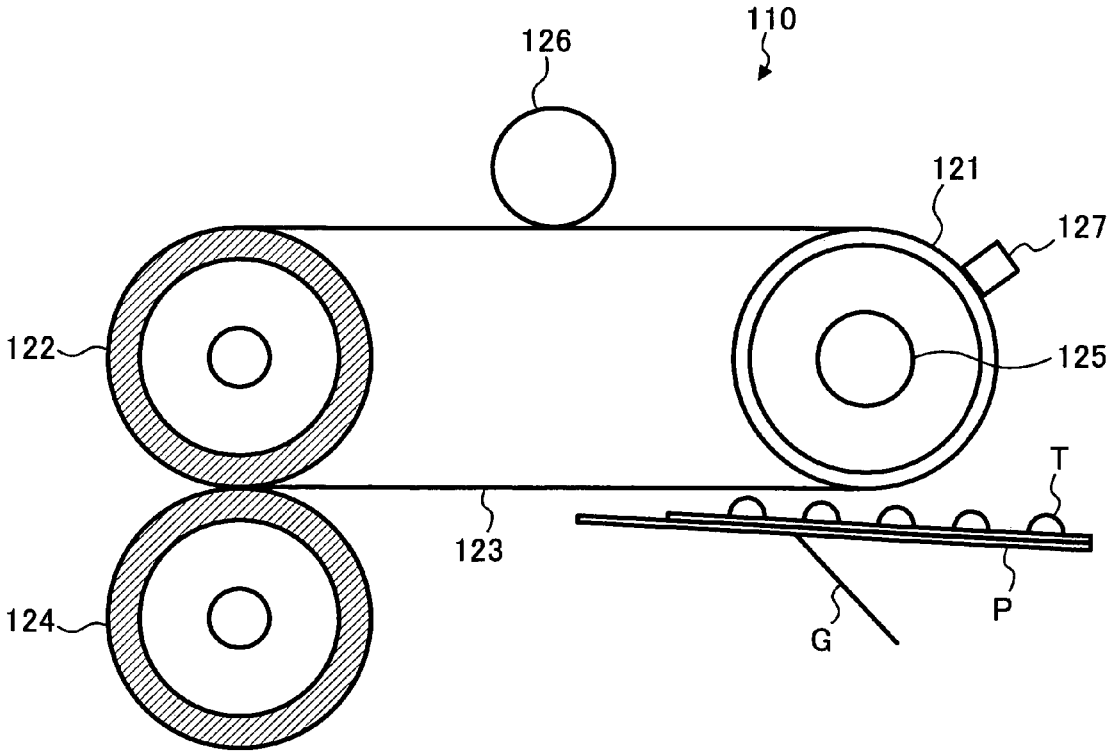
FIG. 5 is a schematic view illustrating a fixing device for use in the image forming apparatus of the present invention.

FIG. 5 is a schematic view illustrating a fixing device for use in the image forming apparatus of the present invention.

A belt fixing device 110 includes a heat roller 121, a fixing roller 122, a pressure roller 122, a pressure roller 124 and a fixing belt 123. The fixing belt 123 is tightly stretched with the heat roller 121 and the fixing roller 122 and is heated by the heat roller 121 to a predetermined temperature. A heat source 125 is arranged inside the heat roller 121. A temperature sensor 127 is provided in the vicinity of the heat roller 121 to measure and control the temperature of the heat roller 121. The fixing roller 122 is rotatably arranged while contacting the inner surface of the fixing belt 123. The pressure roller 124 is rotatably arranged while pressing the fixing belt 123 and the fixing roller 122.

A receiving sheet P having a toner image T thereon is fed to the heat roller 121. The toner image is heated with the heat roller 121 and the fixing belt 123, which are heated to the predetermined temperature by the heat source 125, thereby melting the toner image T. The receiving sheet P having a melted toner image thereon is fed to the nip between the fixing roller 122 and the pressure roller 124. The toner image T is contacted with the fixing belt 123 which is interlockingly rotated with the fixing roller 122 and the pressure roller 124. The toner image T is pressed with the pressure roller 124 at the nip, thereby fixing the toner image T on the receiving sheet P. The toner image T thus fixed on the receiving sheet P is released from the fixing belt 123 and is fed along a guide G. Thus the receiving sheet P is discharged to a tray (not shown). The surface of the fixing belt 123 is cleaned with a cleaning roller 126.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Manufacturing Example 1

Preparation of Particulate Resin Dispersion (1)

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 83 parts of styrene, 83 parts of methacrylic acid, 110 parts of butyl acrylate, and 1 part of ammonium persulfate were contained. The mixture was agitated for 15 minutes while the stirrer was rotated at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion of a vinyl resin (i.e., a copolymer of styrene/methacrylic acid/butyl acrylate/sodium salt of sulfate of ethylene oxide adduct of methacrylic acid) was prepared (this dispersion is hereinafter referred to as particulate resin dispersion (1)).

The volume average particle diameter (Dv) of the particles in the particulate resin dispersion (1) was 100 nm. Part of the particulate resin dispersion (1) was heated to solidify the resin. The glass transition temperature (Tg), number average molecular weight (Mn) and weight average molecular weight (Mw) of the resin were 80° C., 1,700 and 10,000, respectively.

Manufacturing Example 2

Preparation of Particulate Resin Dispersion (2)

The procedure for preparation of the particulate resin dispersion (1) was repeated except that the added amounts of styrene, methacrylic acid and butyl acrylate were changed to 79 parts, 79 parts and 105 parts, respectively, and 13 parts of 1,6-hexanedioldiacrylate were added. Thus, an aqueous dispersion of a vinyl resin (i.e., a copolymer of styrene/methacrylic acid/butyl acrylate/sodium salt of sulfate of ethylene oxide adduct of methacrylic acid/1,6-hexanedioldiacrylate) was prepared (this dispersion is hereinafter referred to as particulate resin dispersion (2))

The volume average particle diameter (Dv) of the particles in the particulate resin dispersion (2) was 105 nm. Part of the particulate resin dispersion (2) was heated to solidify the resin. The glass transition temperature (Tg), number average molecular weight (Mn) and weight average molecular weight (Mw) of the resin were 105° C., 167,000 and 1,000,000, respectively.

Manufacturing Example 3

Preparation of Particulate Resin Dispersion (3)

The procedure for preparation of the particulate resin dispersion (1) was repeated except that the added amount of ELEMINOL RS-30 was changed from 11 parts to 21 parts, and 13 parts of 1-dodecyl mercaptan (THIOKALCOHL 20 from Kao Corp.) were added. Thus, an aqueous dispersion of a vinyl resin (i.e., a copolymer of styrene/methacrylic acid/butyl acrylate/sodium salt of sulfate of ethylene oxide adduct of methacrylic acid) was prepared (this dispersion is hereinafter referred to as particulate resin dispersion (3)).

The volume average particle diameter (Dv) of the particles in the particulate resin dispersion (3) was 15 nm. Part of the particulate resin dispersion (3) was heated to solidify the resin. The glass transition temperature (Tg), number average molecular weight (Mn) and weight average molecular weight (Mw) of the resin were 95° C., 1,000 and 5,000, respectively.

Manufacturing Example 4

Preparation of Particulate Resin Dispersion (4)

The procedure for preparation of the particulate resin dispersion (1) was repeated except that the added amounts of ELEMINOL RS-30, styrene, methacrylic acid and butyl acrylate were changed to 3 parts, 71 parts, 71 parts and 98 parts, respectively, and 14 parts of 1,6-hexanedioldiacrylate were added. Thus, an aqueous dispersion of a vinyl resin (i.e., a copolymer of styrene/methacrylic acid/butyl acrylate/sodium salt of sulfate of ethylene oxide adduct of methacrylic acid/1,6-hexanedioldiacrylate) was prepared (this dispersion is hereinafter referred to as particulate resin dispersion (4)).

The volume average particle diameter (Dv) of the particles in the particulate resin dispersion (4) was 600 nm. Part of the particulate resin dispersion (4) was heated to solidify the resin. The glass transition temperature (Tg), number average molecular weight (Mn) and weight average molecular weight (Mw) of the resin were 105° C., 225,000 and 1,800,000, respectively.

Manufacturing Example 5

Preparation of Particulate Resin Dispersion (5)

The procedure for preparation of the particulate resin dispersion (1) was repeated except that the added amounts of ELEMINOL RS-30, styrene, methacrylic acid and butyl acrylate were changed to 8 parts, 82 parts, 82 parts and 109 parts, respectively. Thus, an aqueous dispersion of a vinyl resin (i.e., a copolymer of styrene/methacrylic acid/butyl acrylate/sodium salt of sulfate of ethylene oxide adduct of methacrylic acid) was prepared (this dispersion is hereinafter referred to as particulate resin dispersion (5)).

The volume average particle diameter (Dv) of the particles in the particulate resin dispersion (5) was 200 nm. Part of the particulate resin dispersion (5) was heated to solidify the resin. The glass transition temperature (Tg), number average molecular weight (Mn) and weight average molecular weight (Mw) of the resin were 78° C., 15,700 and 110,000, respectively.

Manufacturing Example 6

Preparation of Particulate Resin Dispersion (6)

The procedure for preparation of the particulate resin dispersion (1) was repeated except that the added amounts of ELEMINOL RS-30, styrene, methacrylic acid and butyl acrylate were changed to 8 parts, 79 parts, 79 parts and 105 parts, respectively, and 13 parts of 1,6-hexanedioldiacrylate were added. Thus, an aqueous dispersion of a vinyl resin (i.e., a copolymer of styrene/methacrylic acid/butyl acrylate/sodium salt of sulfate of ethylene oxide adduct of methacrylic acid/1,6-hexanedioldiacrylate) was prepared (this dispersion is hereinafter referred to as particulate resin dispersion (6)).

The volume average particle diameter (Dv) of the particles in the particulate resin dispersion (6) was 200 nm. Part of the particulate resin dispersion (6) was heated to solidify the resin. The glass transition temperature (Tg), number average molecular weight (Mn) and weight average molecular weight (Mw) of the resin were 107° C., 220,000 and 1,100,000, respectively.

Manufacturing Example 7

Preparation of Particulate Resin Dispersion (7)

The procedure for preparation of the particulate resin dispersion (1) was repeated except that the added amounts of ELEMINOL RS-30, styrene, methacrylic acid and butyl acrylate were changed to 6 parts, 85 parts, 85 parts and 111 parts, respectively. Thus, an aqueous dispersion of a vinyl resin (i.e., a copolymer of styrene/methacrylic acid/butyl acrylate/sodium salt of sulfate of ethylene oxide adduct of methacrylic acid) was prepared (this dispersion is hereinafter referred to as particulate resin dispersion (7)).

The volume average particle diameter (Dv) of the particles in the particulate resin dispersion (7) was 300 nm. Part of the particulate resin dispersion (7) was heated to solidify the resin. The glass transition temperature (Tg), number average molecular weight (Mn) and weight average molecular weight (Mw) of the resin were 78° C., 2,100 and 9,900, respectively.

Manufacturing Example 8

Preparation of Particulate Resin Dispersion (8)

The procedure for preparation of the particulate resin dispersion (1) was repeated except that the added amounts of ELEMINOL RS-30, styrene, methacrylic acid and butyl acrylate were changed to 5 parts, 81 parts, 81 parts and 107 parts, respectively, and 13 parts of 1,6-hexanedioldiacrylate were added. Thus, an aqueous dispersion of a vinyl resin (i.e., a copolymer of styrene/methacrylic acid/butyl acrylate/sodium salt of sulfate of ethylene oxide adduct of methacrylic acid/1,6-hexanedioldiacrylate) was prepared (this dispersion is hereinafter referred to as particulate resin dispersion (8)).

The volume average particle diameter (Dv) of the particles in the particulate resin dispersion (8) was 295 nm. Part of the particulate resin dispersion (8) was heated to solidify the resin. The glass transition temperature (Tg), number average molecular weight (Mn) and weight average molecular weight (Mw) of the resin were 105° C., 100,000 and 1,000,000, respectively.

The formulae of the raw materials of the dispersions (1) to (8) are shown in Table 1.

TABLE 1

| Resin | Raw materials | | | | | | |
|---|---|---|---|---|---|---|---|
| Dispersion | Water | RS-30 | Styrene | MAA* | BA** | $(NH_4)_2S_2O_8$ | Others |
| No. 1 | 683 | 11 | 83 | 83 | 110 | 1 | — |
| No. 2 | 683 | 11 | 79 | 79 | 105 | 1 | HDDA*3 (13) |
| No. 3 | 683 | 11 | 83 | 83 | 110 | 1 | TK*4 (13) |
| No. 4 | 683 | 3 | 71 | 71 | 98 | 1 | HDDA*3 (14) |
| No. 5 | 683 | 8 | 82 | 82 | 109 | 1 | — |
| No. 6 | 683 | 8 | 79 | 79 | 105 | 1 | HDDA*3 (13) |
| No. 7 | 683 | 6 | 85 | 85 | 111 | 1 | — |
| No. 8 | 683 | 5 | 81 | 81 | 107 | 1 | HDDA*3 (13) |

MAA*: methacrylic acid
BA**: butyl acrylate
HDDA*3: 1,6-hexanedioldiacrylate
TK*4: TIOKALCOHL 20 (1-dodecyl mercaptan)

The physical properties of the dispersions (1) to (8) are shown in Table 2.

TABLE 2

| Resin dispersion | Dv (nm) | Tg (° C.) | Mn | Mw |
|---|---|---|---|---|
| No. 1 | 100 | 80 | 1700 | 10000 |
| No. 2 | 105 | 105 | 167000 | 1000000 |
| No. 3 | 15 | 95 | 1000 | 5000 |
| No. 4 | 600 | 105 | 225000 | 1800000 |
| No. 5 | 200 | 78 | 15700 | 110000 |
| No. 6 | 200 | 107 | 220000 | 1100000 |
| No. 7 | 300 | 78 | 2100 | 9900 |
| No. 8 | 295 | 105 | 100000 | 1000000 |

The volume average particle diameter (Dv) was measured with a laser particle diameter measuring instrument LA-920 from Horiba Ltd.

The glass transition temperature (Tg) was measured by the above-mentioned method using TAS-100 from Rigaku Corp.

The number average and volume average molecular weights were measured by the above-mentioned method using gel permeation chromatography.

Example 1

Preparation of Unmodified Polyester Resin (1)

The following components were contained in a reaction vessel equipped with a condenser, a stirrer and a nitrogen introducing tube to perform a polycondensation reaction for 8 hours at 230° C. under normal pressure.

| | |
|---|---|
| Ethylene oxide adduct (2 mole) of bisphenol A | 220 parts |
| Propylene oxide adduct (3 mole) of bisphenol A | 561 parts |
| Terephthalic acid | 218 parts |
| Adipic acid | 48 parts |
| Dibutyl tin oxide | 2 parts |

The reaction was further continued for 5 hours under a reduced pressure of from 10 to 15 mmHg. Then 45 parts of trimellitic anhydride were added thereto and the mixture was reacted for 2 hours at 180° C. under normal pressure. Thus, an unmodified polyester resin (1) was prepared.

The unmodified polyester resin (1) had a number average molecular weight (Mn) of 2,500, a weight average molecular weight (Mw) of 6,700, a glass transition temperature of 43° C., and an acid value of 25 mgKOH/g.

Preparation of Prepolymer (1)

The following components were contained in a reaction vessel equipped with a condenser, a stirrer and a nitrogen introducing tube and reacted for 8 hours at 230° C. under normal pressure.

| | |
|---|---|
| Ethylene oxide adduct (2 mole) of bisphenol A | 682 parts |
| Propylene oxide adduct (3 mole) of bisphenol A | 81 parts |
| Terephthalic acid | 283 parts |
| Trimellitic anhydride | 22 parts |
| Dibutyl tin oxide | 2 parts |

The reaction was further continued for 5 hours under a reduced pressure of from 10 to 15 mmHg.

Thus, a polyester intermediate (1) was prepared.

The polyester intermediate (1) had a number average molecular weight (Mn) of 2,100, a weight average molecular weight (Mw) of 9,500, a glass transition temperature of 55° C., an acid value of 0.5 mgKOH/g, and a hydroxyl value of 49 mgKOH/g.

Then the following components were contained in a reaction vessel equipped with a condenser, a stirrer and a nitrogen introducing tube and reacted for 5 hours at 100° C.

| | |
|---|---|
| Polyester intermediate (1) | 410 parts |
| Isophoronediisocyanate | 89 parts |
| Ethyl acetate | 500 parts |

Thus, a polyester prepolymer (1) having an isocyanate group was prepared. The content of free isocyanate therein was 1.53% by weight.

Preparation of Ketimine Compound (1)

In a reaction vessel equipped with a stirrer and a thermometer, 170 parts of isophorone diamine and 75 parts of methyl ethyl ketone were contained and reacted for 5 hours at 50° C. to prepare a ketimine compound. The ketimine compound (1) has an amine value of 418 mgKOH/g.

Preparation of Masterbatch (1)

The following components were mixed with a HENSCHEL MIXER.

| | |
|---|---|
| Carbon black (REGAL 400R from Cabot Corp.) | 40 parts |
| Polyester resin (RS801 from Sanyo Chemical Industries Ltd.; acid value of 10 mgKOH/g, weight average molecular weight (Mw) of 20,000, and glass transition temperature (Tg) of 64° C.) | 60 parts |
| Water | 30 parts |

The mixture was kneaded with a two-roll mill for 45 minutes at 130° C., followed by roll cooling and pulverization with a pulverizer (manufactured by Hosokawa Micron Co., Ltd.). Thus, a masterbatch (1) having a particle diameter of 1 mm was prepared.

Preparation of Organic Solvent Liquid (1)

The following components were contained in a reaction vessel equipped with a stirrer and a thermometer.

| | |
|---|---|
| Unmodified polyester prepared above | 378 parts |
| Carnauba wax | 110 parts |
| Charge controlling agent (Salicylic acid metal complex E-84 from Orient Chemical Co., Ltd.) | 22 parts |
| Ethyl acetate | 947 parts |

The mixture was heated to 80° C. while agitating. After agitated for 5 hours at 80° C., the mixture was cooled to 30° C. in one hour.

Then 500 parts of the masterbatch and 500 parts of ethyl acetate were added thereto and the mixture was agitated for 1 hour.

Then 1324 parts of the mixture were subjected to a dispersion treatment using a bead mill (ULTRAVISCOM-ILL from Aimex Co., Ltd.) to disperse the carbon black and carnauba wax. The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 1324 parts of 65% ethyl acetate solution of the unmodified polyester prepared above were added thereto. The mixture was subjected to the dispersion treatment using the bead mill. The dispersion conditions are the same as those mentioned above except that the dispersion operation was performed once (i.e., one pass).

The thus prepared organic solvent liquid (1) had a solid content of 50% when it was determined by a method in which the liquid is heated at 130° C. for 30 minutes.

Emulsification and Dispersion

The following components were contained in a vessel.

| | |
|---|---|
| Organic solvent liquid (1) prepared above | 648 parts |
| Prepolymer (1) prepared above | 154 parts |
| Ketimine compound (1) prepared above | 6.6 parts |

The components were mixed with a TK HOMOMIXER from Tokushu Kika Kogyo K.K. Thus, an oil phase liquid (1) was prepared.

Then the following components were mixed for 1 minute in a vessel using a TK HOMOMIXER, which was rotated at a revolution of 3000 rpm.

| | |
|---|---|
| Water | 990 parts |
| Particulate resin dispersion (1) | 72 parts |
| Particulate resin dispersion (2) | 8 parts |
| Sodium salt of dodecyl diphenyl ether disulfonic acid (ELEMINOL MON-7 from Sanyo Chemical Industries Ltd., solid content of 48.5%) | 40 parts |
| Ethyl acetate | 90 parts |

Then 809 parts of the oil phase liquid (1) were added to the mixture prepared above, and the mixture was agitated for 20 minutes at a revolution of 13,000 rpm. Thus, an emulsion was prepared.

Then the emulsion was contained in a vessel equipped with a stirrer and a thermometer, and heated at 30° C. for 8 hours to remove the organic solvent (i.e., ethyl acetate), followed by aging at 45° C. for 4 hours. Thus, a dispersion (1) was prepared.

The particles included in the dispersion (1) had a volume average particle diameter (Dv) of 4.95 μm and a number average particle diameter (Dn) of 4.45 μm.

Washing and Drying

One hundred parts of the dispersion 1 were filtered under a reduced pressure. The wet cake was mixed with 300 parts of deionized water and the mixture was agitated for 10 minutes with a TK HOMOMIXER at a revolution of 12,000 rpm, followed by filtering. This washing operation was repeated 3 times. Thus, a final wet cake was prepared.

The thus prepared wet cake was dried for 48 hours in a circulating dryer heated to 45° C., followed by sieving with a screen having openings of 75 μm. Thus toner particles are prepared.

Treatment with External Additive

One hundred parts of the toner particles were mixed with 0.7 parts of a hydrophobized silica and 0.3 parts of a hydrophobized titanium oxide using a Henschel mixer from Mitsui Mining Co., Ltd.

Thus, a toner of Example 1 was prepared.

Comparative Example 1

The procedure for preparation of the toner in Example 1 was repeated except that in the emulsification and dispersion process the particulate resin dispersions (1) and (2) were replaced with the particulate resin dispersions (3) and (4), respectively.

Thus, a toner of Comparative Example 1 was prepared.

Example 2

The procedure for preparation of the toner in Example 1 was repeated except that the added amounts of the particulate dispersions (1) and (2) were changed from 72 to 40 parts and from 8 to 40 parts, respectively.

Thus, a toner of Example 2 was prepared.

Example 3

The procedure for preparation of the toner in Example 1 was repeated except that the particulate dispersions (1) and (2) were replaced with 48 parts of the particulate resin dispersion (5) and 32 parts of the particulate resin dispersion (6), respectively.

Thus, a toner of Example 3 was prepared.

Example 4

The procedure for preparation of the toner in Example 1 was repeated except that the particulate dispersions (1) and (2) were replaced with 48 parts of the particulate resin dispersion (7) and 32 parts of the particulate resin dispersion (8), respectively.

Thus, a toner of Example 4 was prepared.

The thus prepared toners of Examples 1 to 4 and Comparative Example 1 were evaluated as follows.

1. Particle Diameter of Toner (Dv, Dn, Dv/Dn)

The volume average particle diameter (Dv) and number average particle diameter (Dn) of each toner were measured using an instrument MULTISIZER II from Beckmann Coulter and an aperture of 100 μm. In addition, the ratio Dv/Dn was determined on calculation.

2. Average Circularity (AC)

The average circularity of each toner was determined as follows using a flow-type particle image analyzer FPIA-2100 from Sysmex Corp.:

(1) at first 100 to 150 ml of water from which foreign solid materials have been removed, 0.1 to 0.5 ml of a surfactant (alkylbenzenesulfonate) and 0.1 to 0.5 g of a toner were mixed to prepare a dispersion;

(2) the dispersion is further subjected to a supersonic dispersion treatment for 1 to 3 minutes using a machine manufactured by Honda Denshi Co., Ltd. to prepare a dispersion including particles of from 3,000 to 10,000 pieces/μl;

(3) the dispersion is passed through a detection area formed on a plate in the measuring instrument; and (4) the particles are optically detected by a CCD camera and then the shapes thereof are analyzed with an image analyzer.

The circularity of a particle is determined by the following equation:

$$\text{Circularity}=Cs/Cp,$$

wherein Cp represents the length of the circumference of the projected image of a particle and Cs represents the length of the circumference of a circle having the same area as that of the projected image of the particle.

3. Covering Rate (CR)

The covering rate (CR) of the surface of the toner particles with the particulate resins can be determined by the following method:

(1) toner particles of a toner are observed and photographed using an electron microscope with a power magnification of 50,000 to obtain several different pictures of the toner particles; and (2) portions of the photographs which do not include toner particles having a defective surface such as slanted surface and cracks are analyzed with an image analyzer (LUZEX III from Nireco Corporation) to determine the covering rate.

4. Content of Particulate Resin (Cpr)

The content of the particulate resins are determined by determining the amount of styrene monomer which is generated only from the particulate resins when the toner is subjected to a pyrolysis gas chromatograph mass spectrometry. In addition, the following samples each of which includes a predetermined amount of styrene are also subjected to the pyrolysis gas chromatograph mass spectrometry to prepare a working curve showing the relationship between the content of resin particles and the areas of the peak specific to styrene monomer.

1) a toner including styrene-acrylic copolymer in an amount of 0.01% by weight;

2) a toner including styrene-acrylic copolymer in an amount of 0.10% by weight;

3) a toner including styrene-acrylic copolymer in an amount of 1.00% by weight;

4) a toner including styrene-acrylic copolymer in an amount of 3.00% by weight; and 5) a toner including styrene-acrylic copolymer in an amount of 10.00% by weight.

The measuring conditions are as follows.

(1) Measuring instrument: pyrolysis gas chromatograph mass spectrometer QR-5000 from Shimadzu Corp. with a pyrolysis furnace JHP-3S from Japan Analytical Industry Co., Ltd.;

(2) Pyrolysis temperature and time: 590° C.×12 seconds;

(3) Column: DB-1 having a length of 30 m, an inside diameter of 0.25 mm and a film with 0.25 μm;

(4) Temperature of column: 40° C. (maintained for 2 minutes) to 300° C. at a temperature rising speed of 10° C./min; and (5) Temperature of vaporizing room: 300° C.

5. BET Surface Area (BET)

The BET surface area of each toner is determined using an instrument TRISTAR 3000 from Shimadzu Corp. The method is such that a nitrogen gas is adsorbed on the sample and the surface area is determined using a BET multi-point method.

6. Glass Transition Temperature (Tg)

The glass transition temperature of each toner is measured with a TG-DSC System TAS-100 from Rigaku Corporation. The method is as follows.

(1) about 10 mg of a sample which is contained in an aluminum container is set on a holder unit, and the holder unit is set in an electric furnace;

(2) the sample is heated from room temperature to 150° C. at a temperature rising speed of 10° C./min, followed by heating at 150° C. for 10 minutes and cooling to room temperature; and (3) after the sample is allowed to settle at room temperature, the sample is heated again from room temperature to 150° C. at a temperature rising speed of 10° C./min to obtain a DSC curve.

The glass transition temperature (Tg) of the sample is determined using an analyzing system of TAS-100. The glass transition temperature is defined as the temperature at which the tangent line of the endothermic curve crosses the base line.

The evaluation results are shown in Table 3.

TABLE 3

| | Particle diameter | | | | | | | |
|---|---|---|---|---|---|---|---|---|
| | Dv (μm) | Dn (μm) | Dv/Dn | AC | CR (%) | Cpr (Wt %) | BET ($m^2/g$) | Tg (° C.) |
| Ex. 1 | 5.03 | 4.52 | 1.11 | 0.971 | 92 | 4.3 | 1.5 | 56.2 |
| Ex. 2 | 5.07 | 4.50 | 1.13 | 0.983 | 95 | 4.1 | 2.5 | 61.6 |
| Ex. 3 | 4.80 | 4.17 | 1.15 | 0.977 | 100 | 4.5 | 2.0 | 58.3 |
| Ex. 4 | 5.30 | 4.68 | 1.13 | 0.969 | 77 | 1.8 | 1.7 | 55.2 |
| Comp. Ex. 1 | 8.40 | 6.46 | 1.30 | 0.951 | 31 | 0.3 | 0.4 | 32.0 |

Further, the toners were evaluated with respect to the following items.

7. Image Qualities

Five parts of each of the toners prepared above were mixed with 95 parts of a copper-zinc ferrite carrier which has an average particle diameter of 40 μm and which had been coated with a silicone resin. Thus, two component developers were prepared.

The developers were evaluated as follows.

(1) Fixability (Maximum and Minimum Fixable Temperatures)

Each developer was set in a color copier PRETER 550 from Ricoh Co., Ltd. which has a belt fixing device 110 illustrated in FIG. 6, and solid toner images having a weight of 1.0±0.1 mg/cm$^2$ were produced on sheets of a paper TYPE 6000-70W from Ricoh Co., Ltd. while changing the temperature of the fixing belt (i.e., the heat roller).

The conditions of the fixing device 110 are as follows.

1) Tension of fixing belt 123: 1.5 kg/one side

2) Rotating speed of belt: 170 mm/sec

3) Nip length: 10 mm (in the paper feeding direction)

4) Fixing roller 122

Material: silicone foam with an Asker C hardness of about 30 degree

Diameter: 38 mm

5) Pressure roller 124

Material: iron cylinder having a diameter of 48 mm and a thickness of 1 mm, which is covered with a PFA tube and a silicone rubber layer with a thickness of 1 mm formed thereon Asker C hardness: about 75 degree Diameter: 50 mm 6) Heat roller 121

Material: aluminum cylinder having a thickness of 2 mm

Diameter: 30 mm

7) Fixing belt 123

Material: endless nickel belt which has a width of 310 mm and a thickness of about 40 μm and which is covered with a silicone rubber layer (release layer) with a thickness of about 150 μm.

Diameter: 60 mm

This method is hereinafter referred to as the fixability evaluation method (1).

Maximum Fixable Temperature

The fixed toner images were observed to determine whether a hot offset problem is caused.

The maximum fixable temperature is defined as a fixing temperature above which a hot offset problem is caused.

Minimum Fixable Temperature

At first, the image density (ID1) of each solid image was measured with a densitometer. Then the solid image was rubbed with a pad, and the image density (ID2) of the rubbed solid image was measured with the densitometer to determine the fixing rate (i.e., (ID2/ID1)×100). The fixing temperature above which the fixing rate is not less than 70% is defined as the minimum fixable temperature. The minimum fixable temperature is preferably not higher than 150° C.

8. Preservability

Each toner was contained in a glass container, and the toner was allowed to settle for 20 hours in a chamber heated to 50° C. After cooled to room temperature, the toner was subjected to a penetration test using a method based on JIS K2235-1991 to determine the penetration of the toner in the glass container. In this regard, the more penetration value a toner has, the better preservability the toner has.

9. Overall Evaluation

The toners are graded into the following three ranks while considering the evaluation results mentioned above.

○: The toner is good as a whole.

Δ: The toner is acceptable as a whole.

X: The toner is not acceptable as a whole.

The evaluation results are shown in Table 4.

TABLE 4

| | Fixability | | | |
|---|---|---|---|---|
| | Min. fixable temperature (° C.) | Max. fixable temperature (° C.) | Penetration (mm) | Overall evaluation (rank) |
| Ex. 1 | 100 | 200 | 25.5 | ○ |
| Ex. 2 | 120 | ≧220 | 30 | ○ |
| Ex. 3 | 110 | 210 | 27 | ○ |
| Ex. 4 | 100 | 210 | 30 | ○ |
| Comp. Ex. 1 | 90 | 150 | 6 | X |

As clearly understood from Tables 3 and 4, the toners of Examples 1 to 4 have a good combination of low temperature fixability, hot offset resistance, and preservability. Therefore, the toners are evaluated to be good on the whole. The toner of Comparative Example 1 has good low temperature fixability, but the maximum fixable temperature and the preservability are not acceptable. Therefore, the toner is evaluated to be unacceptable as a whole.

Manufacturing Example 9

Preparation of Particulate Resin Dispersion (9)

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 83 parts of styrene, 83 parts of methacrylic acid, 110 parts of butyl acrylate, and 1 part of ammonium persulfate were contained. The mixture was agitated for 15 minutes while the stirrer was rotated at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion of a vinyl resin (i.e., a copolymer of styrene/methacrylic acid/butyl acrylate/sodium salt of sulfate of ethylene oxide adduct of methacrylic acid) was prepared (this dispersion is hereinafter referred to as particulate resin dispersion (9)).

The volume average particle diameter (Dv) of the particles in the particulate resin dispersion (9) was 100 nm. Part of the particulate resin dispersion (9) was heated to solidify the resin. The glass transition temperature (Tg), and the weight average molecular weight (Mw) of the resin were 80° C., and 10,000, respectively.

Manufacturing Example 10

Preparation of Particulate Resin Dispersion (10)

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 83 parts of styrene, 83 parts of methacrylic acid, 110 parts of butyl acrylate, 13.8 parts of 1,6-hexanediol diacrylate, and 1 part of ammonium persulfate were contained. The mixture was agitated for 15 minutes while the stirrer was rotated at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion of a vinyl resin (i.e., a copolymer of styrene/methacrylic acid/butyl acrylate/1,6-hexanediol diacrylate/sodium salt of sulfate of ethylene oxide adduct of methacrylic acid) was prepared (this dispersion is hereinafter referred to as particulate resin dispersion (10)).

The volume average particle diameter (Dv) of the particles in the particulate resin dispersion (10) was 130 nm. Part of the particulate resin dispersion (10) was heated to solidify the resin. The glass transition temperature (Tg) was 110° C. The weight average molecular weight (Mw) of the resin could not be determined because almost all components of the resin were insoluble in solvents.

Example 5

Preparation of Aqueous Phase Liquid (1)

The following components were mixed to prepare an aqueous phase liquid.

| | |
|---|---|
| Water | 990 parts |
| Particulate resin dispersion (9) | 43 parts |
| Particulate resin dispersion (10) | 40 parts |
| Sodium dodecyl diphenyl ether disulfonate (ELEMINOL MON-7 from Sanyo Chemical Industries Ltd., solid content of 48.5%) | 37 parts |
| Ethyl acetate | 90 parts |

The thus prepared aqueous phase liquid (1) had a milky color.

Preparation of Masterbatch (2)

The following components were mixed with a HENSCHEL MIXER from Mitsui Mining Co., Ltd.

| | |
|---|---|
| Water | 1200 parts |
| Carbon black (PRINTEX from Degussa A.G., DBP absorption of 42 ml/100 mg, pH of 9.5) | 540 parts |
| Polyester resin (RS801 from Sanyo Chemical Industries Ltd.) | 1200 parts |

The mixture was then kneaded for 30 minutes at 150° C. using a two-roll mill. The kneaded mixture was subjected to roll cooling, followed by pulverization using a pulverizer from Hosokawa Micron Corp.

Thus a masterbatch (2) was prepared.

Preparation of Oil Phase Liquid (2)

The following components were contained in a reaction vessel equipped with a stirrer and a thermometer.

| | |
|---|---|
| Unmodified polyester (1) | 378 parts |
| Carnauba wax | 110 parts |
| Charge controlling agent (Salicylic acid metal complex E-84 from Orient Chemical Co., Ltd.) | 22 parts |
| Ethyl acetate | 947 parts |

The mixture was heated to 80° C. while agitating. After agitated for 5 hours at 80° C., the mixture was cooled to 30° C. in one hour.

Then 500 parts of the masterbatch (2) and 500 parts of ethyl acetate were added thereto and mixed for 1 hour.

Then 1324 parts of the mixture were subjected to a dispersion treatment using a bead mill (ULTRAVISCOMILL from Aimex Co., Ltd.) to disperse the carbon black and carnauba wax. The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 1324 parts of 65% ethyl acetate solution of the unmodified polyester (1) prepared above were added thereto. The mixture was subjected to the dispersion treatment using the bead mill. The dispersion conditions are the same as those mentioned above except that the dispersion operation was performed once (i.e., one pass).

The thus prepared oil phase liquid (2) has a solid content of 50% when it was determined by a method in which the liquid is heated at 130° C. for 30 minutes.

Emulsification and Dispersion

The following components were contained in a vessel.

| | |
|---|---|
| Oil phase liquid (2) prepared above | 749 parts |
| Prepolymer (1) | 115 parts |
| Ketimine compound (1) prepared above | 2.9 parts |

The components were mixed for 1 minute with a TK HOMOMIXER from Tokushu Kika Kogyo K.K., which was rotated at a revolution of 5000 rpm. Then 1200 parts of the aqueous phase liquid (1) prepared above were added thereto, and the mixture was further mixed for 20 minutes at a revolution of 3000 rpm. Thus, an emulsion was prepared.

Then the emulsion was contained in a vessel equipped with a stirrer and a thermometer, and heated at 30° C. for 8 hours to remove the organic solvent (i.e., ethyl acetate), followed by aging at 45° C. for 4 hours. Thus, a dispersion was prepared.

The particles included in the dispersion had a volume average particle diameter (Dv) of 5.86 μm and a number average particle diameter (Dn) of 5.11 μm when the particle diameters were measured with MULTISIZER TA III from Beckmann Coulter.

Washing and Drying

One hundred parts of the dispersion were filtered under a reduced pressure. The wet cake was mixed with 300 parts of deionized water and the mixture was agitated for 10 minutes with TK HOMOMIXER at a revolution of 12,000 rpm, followed by filtering. The thus prepared wet cake was mixed with 100 parts of a 10% aqueous solution of sodium hydroxide, and the mixture was agitated for 30 minutes with TK HOMOMIXER at a revolution of 12,000 rpm, followed by filtering under a reduced pressure. Then the wet cake was mixed with 100 parts of a 10% aqueous solution of hydrochloric acid, and the mixture was agitated for 10 minutes with TK HOMOMIXER at a revolution of 12,000 rpm, followed by filtering under a reduced pressure. Further, the wet cake was mixed with 300 parts of deionized water, and the mixture was agitated for 10 minutes with TK HOMOMIXER at a revolution of 12,000 rpm, followed by filtering. This washing operation using deionized water was repeated twice. Thus, a final wet cake was prepared.

The thus prepared wet cake was dried for 48 hours in a circulating dryer heated to 45° C., followed by sieving with a screen having openings of 75 μm. Thus toner particles are prepared.

Treatment with External Additive

One hundred parts of the toner particles were mixed with 0.7 parts of a hydrophobized silica and 0.3 parts of a hydrophobized titanium oxide using a HENSCHEL MIXER from Mitsui Mining Co., Ltd.

Thus, a toner of Example 5 was prepared.

Example 6

The procedure for preparation of the toner in Example 5 was repeated except that the aqueous phase liquid (1) was replaced with the following aqueous phase liquid (2).

Formula of Aqueous Phase Liquid (2)

| | |
|---|---|
| Water | 990 parts |
| Particulate resin dispersion (9) | 106 parts |
| Particulate resin dispersion (10) | 44 parts |
| Sodium dodecyldiphenylether disulfonate (ELEMINOL MON-7 from Sanyo Chemical Industries Ltd., solid content of 48.5%) | 37 parts |
| Ethyl acetate | 90 parts |

Thus, a toner of Example 6 was prepared.

Example 7

The procedure for preparation of the toner in Example 5 was repeated except that the aqueous phase liquid (1) was replaced with the following aqueous phase liquid (3).

Formula of Aqueous Phase Liquid (3)

| | |
|---|---|
| Water | 990 parts |
| Particulate resin dispersion (9) | 50 parts |
| Particulate resin dispersion (10) | 33 parts |
| Sodium dodecyldiphenylether disulfonate (ELEMINOL MON-7 from Sanyo Chemical Industries Ltd., solid content of 48.5%) | 37 parts |
| Ethyl acetate | 90 parts |

Thus, a toner of Example 7 was prepared.

Example 8

The procedure for preparation of the toner in Example 5 was repeated except that the aqueous phase liquid (1) was replaced with the following aqueous phase liquid (4).

Formula of Aqueous Phase Liquid (4)

| | |
|---|---|
| Water | 990 parts |
| Particulate resin dispersion (10) | 41 parts |
| Below-mentioned particulate resin dispersion (11) | 42 parts |
| Sodium dodecyldiphenylether disulfonate (ELEMINOL MON-7 from Sanyo Chemical Industries Ltd., solid content of 48.5%) | 37 parts |
| Ethyl acetate | 90 parts |

Preparation of Particulate Resin Dispersion (11)

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 80 parts of styrene, 83 parts of methacrylic acid, 110 parts of butyl acrylate, 110 parts of butyl thioglycolate, and 1 part of ammonium persulfate were contained. The mixture was agitated for 15 minutes while the stirrer was rotated at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion of a vinyl resin (i.e., a copolymer of styrene/methacrylic acid/butyl acrylate/butyl thioglycolate/sodium salt of sulfate of ethylene oxide adduct of methacrylic acid) was prepared (this dispersion is hereinafter referred to as particulate resin dispersion (11)).

The volume average particle diameter (Dv) of the particles in the particulate resin dispersion (11) was 120 nm. Part of the particulate resin dispersion (11) was heated to solidify the resin. The glass transition temperature (Tg) was 42° C. The weight average molecular weight (Mw) of the resin was 30,000.

Thus, a toner of Example 8 was prepared.

Example 9

The procedure for preparation of the toner in Example 5 was repeated except that the aqueous phase liquid (1) was replaced with the following aqueous phase liquid (5).

Formula of Aqueous Phase Liquid (5)

| | |
|---|---|
| Water | 990 parts |
| Particulate resin dispersion (9) | 71 parts |
| Particulate resin dispersion (10) | 12 parts |
| Sodium dodecyldiphenylether disulfonate (ELEMINOL MON-7 from Sanyo Chemical Industries Ltd., solid content of 48.5%) | 37 parts |
| Ethyl acetate | 90 parts |

Thus, a toner of Example 9 was prepared.

Example 10

The procedure for preparation of the toner in Example 5 was repeated except that in the washing process 100 parts of the 10% sodium hydroxide solution were replaced with 100 parts of distilled water.

Comparative Example 2

The procedure for preparation of the toner in Example 10 was repeated except that the aqueous phase liquid (1) was replaced with the following aqueous phase liquid (7).

Formula of Aqueous Phase Liquid (7)

| | |
|---|---|
| Water | 990 parts |
| Particulate resin dispersion (9) | 83 parts |
| Sodium dodecyldiphenylether disulfonate (ELEMINOL MON-7 from Sanyo Chemical Industries Ltd., solid content of 48.5%) | 37 parts |
| Ethyl acetate | 90 parts |

Thus, a toner of Comparative Example 2 was prepared.

Comparative Example 3

The procedure for preparation of the toner in Example 5 was repeated except that the aqueous phase liquid (1) was replaced with the aqueous phase liquid (7) prepared above.

Thus, a toner of Comparative Example 3 was prepared.

The thus prepared toners of Examples 5 to 10 and Comparative Examples 2 and 3 were evaluated as follows.

1. Particle Diameter of Toner (Dv, Dn, Dv/Dn)

The volume average particle diameter (Dv) and number average particle diameter (Dn) of each toner were measured using an instrument MULTISIZER TA III from Beckmann Coulter and an aperture of 100 μm to determine the ratio Dv/Dn.

2. Average Circularity (AC)

The average circularity of each toner was determined by the method mentioned above using a flow-type particle image analyzer FPIA-2100 from Sysmex corp.

(1) at first 100 to 150 ml of water from which foreign solid materials have been removed, 0.1 to 0.5 ml of a surfactant (alkylbenzenesulfonate) and 0.1 to 0.5 g of a toner were mixed to prepare a dispersion;

(2) the dispersion is further subjected to a supersonic dispersion treatment for 1 to 3 minutes using a dispersing machine (BRANSON) from Yamato Co., Ltd. to prepare a dispersion including particles of from 3,000 to 10,000 pieces/μl;

(3) the dispersion is passed through a detection area formed on a plate in the measuring instrument; and (4) the particles are optically detected by a CCD camera and then the shapes thereof are analyzed with an image analyzer.

The circularity of a particle is determined by the following equation:

$$\text{Circularity}=Cs/Cp,$$

wherein Cp represents the length of the circumference of the projected image of a particle and Cs represents the length of the circumference of a circle having the same area as that of the projected image of the particle.

3. Content of Particulate Resin (Cpr)

The content of the particulate resins are determined by the method mentioned above.

The evaluation results are shown in Table 5.

TABLE 5

| | Particle diameter | | | | |
|---|---|---|---|---|---|
| | Dv (μm) | Dn (μm) | Dv/Dn | AC | Cpr (%) |
| Ex. 5 | 5.93 | 5.06 | 1.17 | 0.984 | 2.16 |
| Ex. 6 | 6.11 | 4.96 | 1.23 | 0.972 | 2.76 |

TABLE 5-continued

| | Particle diameter | | | | |
|---|---|---|---|---|---|
| | Dv (μm) | Dn (μm) | Dv/Dn | AC | Cpr (%) |
| Ex. 7 | 5.89 | 4.81 | 1.22 | 0.956 | 1.57 |
| Ex. 8 | 5.79 | 4.86 | 1.19 | 0.961 | 2.13 |
| Ex. 9 | 6.03 | 5.10 | 1.18 | 0.976 | 0.82 |
| Ex. 10 | 6.13 | 5.13 | 1.19 | 0.981 | 4.10 |
| Comp. Ex. 2 | 5.86 | 4.99 | 1.17 | 0.987 | 4.24 |
| Comp. Ex. 3 | 5.46 | 4.65 | 1.17 | 0.982 | 0.44 |

Further, the toners were evaluated with respect to the following items.

5. Image Qualities

Five parts of each of the toners prepared above were mixed with 95 parts of a copper-zinc ferrite cattier which has an average particle diameter of 40 μm and which had been coated with a silicone resin. Thus, two component developers were prepared.

The developers were evaluated as follows.

(1) Fixability (Maximum and Minimum Fixable Temperatures)

Each developer was set in an image forming apparatus IMAGIO NEO 450 from Ricoh Co., Ltd., and solid toner images having a weight of 1.0±0.1 mg/cm$^2$ were produced on sheets of a paper TYPE 6200 from Ricoh Co., Ltd. and a copy paper <135> from NBS Ricoh while changing the fixing temperature. This method is hereinafter referred to as the fixability evaluation method (2).

Maximum Fixable Temperature

The fixed toner images formed on the sheets of TYPE 6200 were observed to determine whether a hot offset problem is caused (i.e., to determine the maximum fixable temperature). The maximum fixable temperature is defined as a fixing temperature above which a hot offset problem is caused.

Minimum Fixable Temperature

At first, the image density (ID1) of each solid image formed on the sheet of the copy paper <135> was measured with a densitometer. Then the solid image was rubbed with a pad, and the image density (ID2) of the rubbed solid image was measured with the densitometer to determine the fixing rate (i.e., (ID2/ID1)×100). The fixing temperature above which the fixing rate is not less than 70% is defined as the minimum fixable temperature.

Image Density

A 100,000-sheet running test in which an original image having an image area proportion of 5% and including solid images was continuously reproduced. The image densities of 5 points of each of the first image, 10,000$^{th}$ image and 100,000$^{th}$ image were measured with a spectrodensitometer 938 from X-Rite to determine the average image densities of the first image, 10,000$^{th}$ image and 100,000$^{th}$ image.

6. Overall Evaluation

The toners are graded into the following three ranks while considering the evaluation results mentioned above.

○: The toner is good as a whole.

Δ: The toner is acceptable as a whole.

X: The toner is not acceptable as a whole.

The evaluation results are shown in Table 6.

TABLE 6

| | Fixability | | Image density | | | Overall |
|---|---|---|---|---|---|---|
| | Min. fixable temperature (° C.) | Max. fixable temperature (° C.) | 1st image | $10^4$th image | $10^5$th image | evaluation (rank) |
| Ex. 5 | 135 | ≧210 | 1.39 | 1.42 | 1.41 | ○ |
| Ex. 6 | 135 | ≧210 | 1.40 | 1.43 | 1.43 | ○ |
| Ex. 7 | 140 | 200 | 1.43 | 1.43 | 1.44 | ○ |
| Ex. 8 | 140 | ≧210 | 1.39 | 1.41 | 1.44 | ○ |
| Ex. 9 | 130 | 200 | 1.40 | 1.42 | 1.42 | ○ |
| Ex. 10 | 175 | ≧210 | 1.40 | 1.42 | 1.43 | Δ |
| Comp. Ex. 2 | 150 | ≧210 | 1.38 | 1.39 | 1.41 | X |
| Comp. Ex. 3 | 135 | 200 | 1.39 | — | — | X |

As clearly understood from Tables 5 and 6, the toners of Examples 5 to 9 have good fixability and can produce images having high image density even when used for a long period of time.

The minimum fixable temperature of the toners of Example 10 is relatively high compared to those of the toner of Examples 5 to 9 because a basic aqueous solution is not used for the washing operation.

The minimum fixable temperature of the toner of Comparative Example 2 is relatively high compared to those of the toner of Examples 5 to 9 because only one particulate resin is present on the surface of the toner particles.

The image density of the images produced by the toner of Comparative Example 3 decreased with time when the running test was performed. Therefore, the running test was stopped before production of 10,000 images.

Manufacturing Example 11

Preparation of Particulate Resin Dispersion (12)

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 79 parts of styrene, 79 parts of methacrylic acid, 105 parts of butyl acrylate, 13 parts of divinylbenzene, and 1 part of ammonium persulfate were contained. The mixture was agitated for 15 minutes while the stirrer was rotated at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion of a vinyl resin (i.e., a copolymer of styrene/methacrylic acid/butyl acrylate/divinylbenzene/sodium salt of sulfate of ethylene oxide adduct of methacrylic acid) was prepared (this dispersion is hereinafter referred to as particulate resin dispersion (12)).

The volume average particle diameter (Dv) of the particles in the particulate resin dispersion (12) was 105 nm. Part of the particulate resin dispersion (12) was heated to solidify the resin. The glass transition temperature (Tg) was 95° C. The number average molecular weight (Mn) and the weight average molecular weight (Mw) of the resin were 140,000 and 980,000, respectively.

Example 11

Emulsification

The following components were contained in a vessel and mixed for 1 minute using a TK HOMOMIXER from Tokushu Kika Kogyo K.K. at a revolution of 3,000 rpm.

| | |
|---|---|
| Particulate resin dispersion (12) | 8 parts |
| Particulate resin dispersion (1) | 72 parts |
| Aqueous solution of sodium salt of dodecyl diphenyl ether disulfonic acid (ELEMINOL MON-7 from Snayo Chemical Industries Lt., solid content of 48.5%) | 40 parts |
| Ethyl acetate | 90 parts |

Then 809 parts of the oil phase liquid (1) prepared above were added thereto, and the mixture was agitated for 20 minutes with TK HOMOMIXER at a revolution of 13,000 rpm. Thus, an emulsion was prepared.

In a vessel equipped with a stirrer and a thermometer, the emulsion was subjected to a solvent removing treatment for 8 hours at 30° C., followed by aging at 45° C. for 4 hours. Thus, a dispersion was prepared.

Washing and Drying

One hundred parts of the dispersion prepared above were filtered under a reduced pressure. The wet cake was mixed with 300 parts of deionized water and the mixture was agitated for 10 minutes with a TK HOMOMIXER at a revolution of 12,000 rpm, followed by filtering. This washing operation was repeated 3 times. Thus, a final wet cake was prepared.

The thus prepared wet cake was dried for 48 hours in a circulating dryer heated to 45° C., followed by sieving with a screen having openings of 75 μm.

Thus, a toner of Example 11 was prepared.

Manufacturing Example 12

Preparation of Particulate Resin Dispersion (13)

The procedure for preparation of the particulate resin dispersion (12) was repeated except that the divinylbenzene was replaced with 10 parts of 1,6-hexanediol diacrylate to prepare a particulate resin dispersion (13).

The particulate resin in the dispersion (13) had a volume average particle diameter of 100 nm. In addition, the resin had a glass transition temperature of 100° C., a number average molecular weight (Mn) of 167,000 and a weight average molecular weight (Mw) of 1,000,000.

Example 12

The procedure for preparation of the toner in Example 11 was repeated except that the particulate resin dispersion (12) was replaced with the particulate resin dispersion (13).

Thus, a toner of Example 12 was prepared.

Example 13

The procedure for preparation of the toner in Example 11 was repeated except that the added amounts of the particulate resin dispersion (12) and the particulate resin dispersion (1) was changed to 40 parts and 40 parts, respectively.

Thus, a toner of Example 13 was prepared.

Example 14

The procedure for preparation of the toner in Example 11 was repeated except that the particulate resin dispersion (12) was replaced with 32 parts of the particulate resin dispersion (6) and the particulate resin dispersion (1) was replaced with 48 parts of the particulate resin dispersion (5).

Thus, a toner of Example 14 was prepared.

Manufacturing Example 13

Preparation of Particulate Resin Dispersion (14)

In a reaction vessel equipped with a stirrer and a thermometer, 683 parts of water, 3 parts of a sodium salt of sulfate of an ethylene oxide adduct of methacrylic acid (ELEMINOL RS-30 from Sanyo Chemical Industries Ltd.), 71 parts of styrene, 71 parts of methacrylic acid, 98 parts of butyl acrylate, 20 parts of 1,6-hexanediol diacrylate, and 1 part of ammonium persulfate were contained. The mixture was agitated for 15 minutes while the stirrer was rotated at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion of a vinyl resin (i.e., a copolymer of styrene/methacrylic acid/butyl acrylate/1,6-hexanediol diacrylate/sodium salt of sulfate of ethylene oxide adduct of methacrylic acid) was prepared (this dispersion is hereinafter referred to as particulate resin dispersion (14)).

The volume average particle diameter (Dv) of the particles in the particulate resin dispersion (14) was 600 nm. Part of the particulate resin dispersion (14) was heated to solidify the resin. The glass transition temperature (Tg) was 155° C. The number average molecular weight (Mn) and the weight average molecular weight (Mw) of the resin were 900,000 and 7,200,000, respectively.

Manufacturing Example 14

Preparation of Particulate Resin Dispersion (15)

In a reaction vessel equipped with a stirrer and a thermometer, 683 parts of water, 21 parts of a sodium salt of sulfate of an ethylene oxide adduct of methacrylic acid (ELEMINOL RS-30 from Sanyo Chemical Industries Ltd.), 83 parts of styrene, 83 parts of methacrylic acid, 110 parts of butyl acrylate, 13 parts of 1-dodecyl mercaptan (THIOKALCOHL 20 from Kao Corp.), and 1 part of ammonium persulfate were contained. The mixture was agitated for 15 minutes while the stirrer was rotated at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion of a vinyl resin (i.e., a copolymer of styrene/methacrylic acid/butyl acrylate/dodecylmercaptan/sodium salt of sulfate of ethylene oxide adduct of methacrylic acid) was prepared (this dispersion is hereinafter referred to as particulate resin dispersion (15)).

The volume average particle diameter (Dv) of the particles in the particulate resin dispersion (15) was 15 nm. Part of the particulate resin dispersion (15) was dried to solidify the resin. The glass transition temperature (Tg) was 20° C. The number average molecular weight (Mn) and the weight average molecular weight (Mw) of the resin were 1,000 and 5,000, respectively.

Comparative Example 4

The procedure for preparation of the toner in Example 12 was repeated except that the particulate resin dispersion (12) was replaced with 48 parts of the particulate resin dispersion (14) and the particulate resin dispersion (1) was replaced with 32 parts of the particulate resin dispersion (15).

The formulae of the raw materials of the dispersions (12) to (15) are shown in Table 7.

TABLE 7

| Resin | Raw materials | | | | | | |
|---|---|---|---|---|---|---|---|
| Dispersion | Water | RS-30 | Styrene | MAA* | BA** | $(NH_4)_2S_2O_8$ | Others |
| No. 12 | 683 | 11 | 79 | 79 | 105 | 1 | DVB*3 (13) |
| No. 13 | 683 | 11 | 79 | 79 | 105 | 1 | HDDA*4 (10) |
| No. 14 | 683 | 3 | 71 | 71 | 98 | 1 | HDDA*4 (20) |
| No. 15 | 683 | 21 | 83 | 83 | 110 | 1 | TK*5 (13) |

MAA*: methacrylic acid
BA**: butyl acrylate
DVB*3: divinylbenzene
HDDA*4: 1,6-hexanedioldiacrylate
TK*5: THIOKALCOHL 20

The physical properties of the dispersions (12) to (15) are shown in Table 8.

TABLE 8

| Resin dispersion | Dv (nm) | Tg (° C.) | Mn | Mw |
|---|---|---|---|---|
| No. 12 | 105 | 95 | 140000 | 980000 |
| No. 13 | 100 | 100 | 167000 | 1000000 |
| No. 14 | 600 | 155 | 900000 | 7200000 |
| No. 15 | 15 | 20 | 1000 | 5000 |

The volume average particle diameter (Dv) was measured with a laser particle diameter measuring instrument LA-920 from Horiba Ltd.

The glass transition temperature (Tg) was measured by the above-mentioned method using TAS-100 from Rigaku Corp.

The number average and volume average molecular weights were measured by the above-mentioned gel permeation chromatography.

The thus prepared toners of Examples 11 to 14 and Comparative Example 4 were evaluated as follows.

1. Particle Diameter of Toner (Dv, Dn, Dv/Dn)

The volume average particle diameter (Dv) and number average particle diameter (Dn) of each toner were measured using an instrument MULTISIZER II from Beckmann Coulter and an aperture of 100 μm to determine the ratio Dv/Dn.

2. Average Circularity (AC)

The average circularity (AC) of each toner was determined by the method mentioned above using a flow-type particle image analyzer FPIA-2100 from Sysmex Corp.:

3. Covering Rate (CR)

The covering rate of the surface of the toner particles with the particulate resins was determined by the method mentioned above.

4. Content of Particulate Resin (Cpr)

The content of the particulate resins are determined by the method mentioned above in which the amount of styrene monomer which is generated only from the particulate resins when the toner is subjected to pyrolysis gas chromatograph mass spectrometry is determined.

5. BET Surface Area (BET)

The BET surface area of each toner is determined by the method mentioned above using an instrument TRISTAR 3000 from Shimadzu Corp.

6. Fixability

The fixability (i.e., maximum fixable temperature and minimum fixable temperature) of each toner was evaluated by the method mentioned above using a copier PRETER 550.

7. Preservability

The preservability of each toner was evaluated by the method specified in JIS K2235-1991, which is mentioned above.

The evaluation results are shown in Tables 9 and 10.

TABLE 9

| | Particle diameter | | | | | | |
|---|---|---|---|---|---|---|---|
| | Dv (μm) | Dn (μm) | Dv/Dn | AC | CR (%) | Cpr (Wt %) | BET ($m^2/g$) |
| Ex. 11 | 5.30 | 4.65 | 1.14 | 0.983 | 92 | 3.8 | 1.4 |
| Ex. 12 | 5.03 | 4.52 | 1.11 | 0.971 | 92 | 4.3 | 1.5 |
| Ex. 13 | 5.07 | 4.50 | 1.13 | 0.983 | 95 | 4.1 | 2.5 |
| Ex. 14 | 4.80 | 4.17 | 1.15 | 0.977 | 100 | 4.5 | 2.0 |
| Comp. Ex. 4 | 8.40 | 6.40 | 1.31 | 0.952 | 30 | 0.3 | 0.4 |

TABLE 10

| | Fixability | | | |
|---|---|---|---|---|
| | Min. Fixable temperature (° C.) | Max. Fixable temperature (° C.) | Penetration (mm) | Overall evaluation (rank) |
| Ex. 11 | 120 | 220 | 24 | ○ |
| Ex. 12 | 100 | 200 | 25.5 | ○ |
| Ex. 13 | 120 | 220 | 30 | ○ |

TABLE 10-continued

| | Fixability | | | |
|---|---|---|---|---|
| | Min. Fixable temperature (° C.) | Max. Fixable temperature (° C.) | Penetration (mm) | Overall evaluation (rank) |
| Ex. 14 | 110 | 210 | 27 | ○ |
| Comp. Ex. 4 | 90 | 150 | 6 | X |

As clearly understood from Tables 9 and 10, the toners of Examples 11 to 14 have a good combination of low temperature fixability, hot offset resistance, and preservability. Therefore, the toners are evaluated to be good as a whole. The toner of Comparative Example 4 has good low temperature fixability, but the maximum fixable temperature and the preservability thereof are not acceptable because one of the particulate resins has too large a weight average molecular weight. Therefore, the toner is evaluated to be unacceptable as a whole.

EFFECTS OF THE PRESENT INVENTION

According to the present invention, a toner which has a good combination of hot offset resistance, preservability and low temperature fixability can be provided.

In addition, the image forming apparatus and the process cartridge of the present invention, which use the toner of the present invention, can produce high quality images.

Further, a method for efficiently producing the toner of the present invention is also provided.

This document claims priority and contains subject matter related to Japanese Patent Applications Nos. 2003-206431, 2003-206433 and 2003-327835, filed on Aug. 7, 2003, Aug. 7, 2003 and Sep. 19, 2003, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

toner particles including a binder resin; and at least two kinds of particulate resins, which are located on at least a surface of the toner particles, wherein the toner satisfies at least one of the following relationships (1) and (2):

$$(TgA-TgB)\geqq 20^\circ\ C. \quad (1)$$

wherein TgA and TgB represent glass transition temperatures of a particulate resin (A) having a highest glass transition temperature and a particulate resin (B) having a lowest glass transition temperature among the at least two kinds of particulate resins, respectively, and $$100{,}000\leqq Mwc\leqq 6{,}000{,}000 \text{ and } 8{,}000\leqq Mwd\leqq 800{,}000 \quad (2)$$

wherein Mwc and Mwd represent weight average molecular weights of tetrahydrofuran-soluble components of a particulate resin (C) having a highest weight average molecular weight and tetrahydrofuran-soluble components of a particulate resin (D) having a lowest weight average molecular weight among the at least two kinds of particulate resins, respectively, wherein Mwc>Mwd.

2. The toner according to claim 1, wherein the toner particles are prepared by a method, comprising:

dispersing a compound having an active hydrogen and a polymer capable of reacting with a hydrogen atom of the compound in an aqueous medium including the at least two kinds of particulate resins;

reacting the polymer with the compound to prepare particles, which include the binder resin and on which the at least two kinds of particulate resins are present; and treating the particles with a basic aqueous solution to remove a part of the at least two kinds of particulate resins and to prepare the toner particles.

3. The toner according to claim 2, wherein in the removing step the part of the at least two kinds of particulate resins is removed while at least one of the at least two kinds of particulate resins is not removed.

4. The toner according to claim 1, wherein a weight ratio (A/B) of the particulate resin (A) to the particulate resin (B) is 10/90 to 50/50.

5. The toner according to claim 1, wherein a weight ratio (C/D) of the particulate resin (C) to the particulate resin (D) is 10/90 to 50/50.

6. The toner according to claim 1, wherein the at least two kinds of particulate resins cover the surface of the toner particles at a covering rate of from 75 to 100%.

7. The toner according to claim 1, wherein each of the at least two kinds of particulate resins has a volume average particle diameter of from 20 to 400 nm.

8. The toner according to claim 1, wherein the at least two kinds of particulate resins are included in the toner in an amount of from 0.5 to 8.0% by weight when the amount is determined by a pyrolysis chromatographic method.

9. The toner according to claim 8, wherein the at least two kinds of particulate resins are included in the toner in an amount of from 0.5 to 5.0% by weight.

10. The toner according to claim 1, wherein the toner has a specific surface area of from 0.5 to 8.0 $m^2/g$, which is determined by a BET method.

11. The toner according to claim 1, wherein the toner has a volume average particle diameter of from 3 to 8 μm.

12. The toner according to claim 1, wherein the toner has a ratio (Dv/Dn) of a volume average particle diameter (Dv) to a number average particle diameter (Dn) of from 1.00 to 1.25.

13. The toner according to claim 1, wherein the toner has an average circularity of from 0.90 to 1.00.

14. The toner according to claim 1, wherein each of the at least two kinds of particulate resins is a resin selected from the group consisting of vinyl resins, polyurethane resins, epoxy resins, and polyester resins.

15. The toner according to claim 1, wherein the particulate resin (A) has a glass transition temperature of from 55 to 150° C. and the particulate resin (B) has a glass transition temperature of from 25 to 100° C.

16. The toner according to claim 1, wherein the binder resin includes a polyester resin.

17. A developer comprising the toner according to claim 1 and a carrier.

18. A toner container containing the toner according to claim 1.

19. An image forming method, comprising:

forming an electrostatic latent image on an image bearing member;

developing the electrostatic latent image with the toner according to claim 1 to form a toner image on the image bearing member;

transferring the toner image onto a receiving material via an intermediate transfer medium; and fixing the toner image on the receiving material.

* * * * *